US009435085B1

(12) United States Patent
Free et al.

(10) Patent No.: US 9,435,085 B1
(45) Date of Patent: Sep. 6, 2016

(54) SYSTEM AND METHOD FOR SLIP FORMING MONOLITHIC REINFORCED COMPOSITE CONCRETE STRUCTURES HAVING MULTIPLE FUNCTIONALLY DISCRETE COMPONENTS

(71) Applicants: Patrick Shawn Free, West Palm Beach, FL (US); Eric C Kontos, Boca Raton, FL (US)

(72) Inventors: Patrick Shawn Free, West Palm Beach, FL (US); Eric C Kontos, Boca Raton, FL (US)

(73) Assignee: RAPTOR LLC, Boynton Beach, FL (US)

( * ) Notice: Subject to any disclaimer, the term of this patent is extended or adjusted under 35 U.S.C. 154(b) by 0 days.

(21) Appl. No.: 14/720,818

(22) Filed: May 24, 2015

(51) Int. Cl.

| | |
|---|---|
| ***E01C 19/48*** | (2006.01) |
| ***E01C 7/00*** | (2006.01) |
| ***E01C 11/18*** | (2006.01) |
| ***E01D 19/00*** | (2006.01) |

(52) U.S. Cl.
CPC ..... *E01C 19/4886* (2013.01); *E01C 7/00* (2013.01); *E01C 11/185* (2013.01); *E01D 19/00* (2013.01)

(58) Field of Classification Search
CPC ..... E01C 7/00; E01C 11/185; E01C 19/00; E01C 19/4886
USPC ..... 404/75, 101, 105, 106, 108; 14/73, 14/77.1; 425/192 R
See application file for complete search history.

(56) References Cited

U.S. PATENT DOCUMENTS

| | | | | |
|---|---|---|---|---|
| 4,084,928 | A * | 4/1978 | Petersik | B28B 1/084 404/100 |
| 4,217,065 | A * | 8/1980 | Stilwell | E01C 19/4886 404/98 |
| 4,312,602 | A * | 1/1982 | Dale | E01C 23/04 404/100 |
| 4,609,303 | A * | 9/1986 | Shumaker | E01C 19/4873 404/101 |
| 6,394,410 | B1 * | 5/2002 | Thompson | E01C 23/04 249/2 |

* cited by examiner

*Primary Examiner* — Raymond W Addie
(74) *Attorney, Agent, or Firm* — John H. Faro, Esq.

(57) ABSTRACT

Systems and methods for the slip forming of reinforced concrete composite structures for road and bridge construction, wherein each functionally discrete component of the composite has at least a portion of its reinforcement, in common with the reinforcement from an antecedent slip formed component of the composite. This system and method are, thus, suitable forming a composite having multiple functionally discrete components within an integrated/monolithic structure. The preferred system and method can sequentially form, in order, structurally discrete component parts for composite concrete road way structures having a road pad, (bridge) coping, traffic rail and barrier wall.

17 Claims, 19 Drawing Sheets

SYSTEM AND METHOD FOR SLIP FORMING MONOLITHIC REINFORCED COMPOSITE CONCRETE STRUCTURES HAVING MULTIPLE FUNCTIONALLY DISCRETE COMPONENTS

CROSS REFERENCE TO RELATED APPLICATIONS

This application is a Continuation-In-Part of commonly assigned, pending PCT Patent Application, PCT/US2014/063605, filed Nov. 2, 2014, which is a Continuation-In-Part of commonly assigned U.S. Ser. No. 14/161,741, filed Jan. 24, 2014 (issued on Feb. 17, 2015 as U.S. Pat. No. 8,956,075), which a Continuation-In-Part of commonly assigned, U.S. Ser. No. 14/071,629, filed Nov. 4, 2104, (issued on Dec. 30, 2014 as U.S. Pat. No. 8,920,068)

BACKGROUND OF THE INVENTION

1. Field of the Invention

This invention relates to the means and methods for the slip forming of reinforced composite concrete structures, having functionally discrete components, for road and bridge construction. More specifically, this invention is directed to the use of a series of tunnel molds, including a first tunnel mold for forming monolithic structure, including a moment or junction slab with exposed rebars, for later integration into an additional structure (e.g. coping or traffic railing). In the exemplary embodiments of this invention, the structure formed upon, and integrated with exposed rebar extending from an antecedent component (such as a moment or junction slab), can include any one, or combination of components slip formed components, such as a coping, traffic rail and/or barrier wall (e.g. opaque traffic wall, sound wall or impact resistant wall).

2. Description of the Prior Art

Slip forming of concrete structures is a well-known technique for preparation of structural concrete elements for various industrial and public works (road, conduit, etc.) projects. Slip forming is a construction method in which a quick setting concrete is poured into the mold cavity of a mold, and the mold is progressively advanced or "slipped" over an iron work array composed of rebars, as the mold cavity the progressively advanced and lays down concrete over the iron work array. The rate of advancement of the mold, relative to the iron work array, is determined, in part, by the green strength of quick setting concrete in the formed concrete structure, specifically, the extent to which the concrete in the formed structure is self-supporting, and is capable of supporting a forward advancing mass of unset concrete, as additional concrete leaves the confines of the slip-mold and is deposited on the iron work array by the forward advancing mold.

Slip forming, thus, enables continuous, non-interrupted, cast-in-place "flawless", (i.e. seamless—no joints), concrete structures, which have superior performance characteristics to piecewise construction, using discretely formed elements. Slip forming relies on the quick-setting properties of concrete, and requires a balance between quick-setting capacity and workability. Concrete needs to be workable enough to be placed into the form and consolidated, (via vibration), yet quick-setting enough to emerge from the form with strength (also "self-supporting strength" or "green strength"). This green strength is needed because the freshly set concrete must not only permit the form to "slip" upwards/forward, but also support the freshly poured concrete above it ("vertical slip forming") and/or the freshly poured concrete in front of it ("horizontal slip forming").

In vertical slip forming, the concrete form may be surrounded by a platform on which workers stand, placing steel reinforcing rods into the concrete and ensuring a smooth pour. Together, the concrete form and working platform are raised by means of hydraulic jacks. Generally, the slip-form rises at a rate which permits the concrete to harden (develop green strength) by the time it emerges from the bottom of the form. In horizontal slip forming for pavement and traffic separation walls, concrete is laid down, vibrated, worked, and settled in place, while the form itself slowly moves ahead. This method was initially devised and utilized in Interstate Highway construction initiated by the Eisenhower administration during the 1950s.

The following text provides a representative, (not exhaustive), review of the prior art in this field:

U.S. Pat. No. 3,792,133 (to Goughnour issued Feb. 12, 1974) describes a method and an apparatus for concrete slip forming a highway barrier wall of varying transverse cross-sectional configuration for accommodating different grade levels on opposite sides of the wall, and wherein variations in the wall cross-sectional configuration may be readily accomplished during wall formation without requiring stopping, realignment or other interruptions in the screed movement during wall forming.

U.S. Pat. No. 4,266,917 (to Godbersen issued Mar. 12, 1981) describes a method for the efficient slip forming of highway median barrier walls of differing size (adjustable height) and shape having any arrangement of linear and curved sections and while the machine is being advanced in a single direction. The lateral adjustability of opposite side walls of the form, relative to the top wall, permits the use of the side walls with top walls of varying widths. The relative vertical adjustment of the top wall and side walls provides for a wide variation in the vertical height of a barrier wall particularly where a glare shield is to be formed on the barrier wall top surface. The slip forming of the glare shield takes place simultaneously and continuously with the slip forming of the barrier wall and over any selected portion of the wall while the machine is being advanced in a single direction. At any adjusted position of the slip form, the skirt member associated with each side wall is adjustable to prevent any flow of concrete from between the ground or highway surface and the form.

U.S. Pat. No. 4,084,928 (to Petersik issued Apr. 18, 1978) describes an improved barrier forming apparatus and method whereby a barrier is formed continuously over a surface, the barrier having continuous reinforcing rods extending the length of the barrier and having cage reinforced standard supports at predetermined intervals along the length of the barrier. The Petersik improved barrier forming assembly comprising a concrete forming member having a form cavity extending there through; a concrete passing member having a concrete delivery opening for passing concrete or the like to the form cavity; and a positioning assembly comprising a support shaft and a door member pivotally supported at a forward end of the concrete forming member, the barrier being extrudable continuously via the form cavity from a rearward end of the concrete forming member. The door member selectively is positionable to partially seal the form cavity at the forward end of the concrete forming member and has rod clearance channels through which the reinforcing rods pass through the door member into the form cavity when the door member is so positioned to seal the form cavity. The rod clearance channels permit the door member to pass the reinforcing rods to open the form cavity at the forward end of the concrete forming member to allow the free passage of the barrier forming assembly over the cage reinforced standard supports.

U.S. Pat. No. 5,290,492 (to Belarde, issued May 1, 1994) describes a system for continuously forming a concrete structure (a) having a predetermined cross-sectional configuration, (b) which extends along an elongate path, and (c) includes an outer surface having a textured pattern comprising concave or convex portions which extend other than just parallel to the elongate path. The system includes a frame, a first form assembly, a second form assembly, a drive system, and a support assembly.

Efforts at slip forming highway structures with exposed rebars have been previously attempted, and unsuccessful for a variety of reasons—not the least of which being that the means and methods adopted do not comport with the engineering requirements of established highway structure specifications which have been issued by both state and federal departments of transportation. Such proposed alternatives to established engineering norms are, thus, neither instructive nor suggestive of solutions to the deficiencies/limitation in well-known and established slip forming construction techniques.

On example of such non-conforming means and methods for slip forming sound walls, (having sequentially formed sections or tiers), is disclosed in Korean Patent No. KR 10-1286959 B1 (to Kim, published Jul. 23, 2013). In the Kim publication, he discloses the slip forming of a sound wall, by progressive or sequential slip forming of a series or sections of the sound wall on top of one another. Each of these sequentially formed sections are connected to one another, with a portion a of rebar, which has been excavated and pried from within the consolidated/hardened concrete of a prior formed slip formed sound wall section. More specifically, the means and methods adopted by Kim are unorthodox, weaken the rebar connection between each of the sections of the sound wall because they require (a) initially providing an iron work array, wherein the rebars of the array have been deformed by bending the top portion of each at right angles, to accommodate their passages through a conventional closed cavity slip mold; (b) slip forming a section of sound wall on such deformed iron work array, wherein the entire iron work array is initially embedded in concrete, and (c) chiseling or prying the deformed rebars out of concrete from the top of the slip formed section of the sound wall section, (d) straightening the deformed top portion of rebar, to provide an erect section or portion thereof for splicing with additional similarly deformed rebars, to form a second rebar array (wherein top portion of each spliced rebar is also bent at right angles), and (e) slip forming the a successive section of sound wall onto this similarly deformed second rebar array. This process is sequentially repeated until the Kim sound wall attains it desired design height. The Kim means and methods, as above described, obviously do not conform to established and accepted engineering practice, (e.g. bending and straightening of reinforcing rebars); and, notwithstanding, the ability to create a connection between successively formed sections of slip formed sound wall, the sections of excavated rebar from one antecedent wall section, do not provide an acceptable the means and method for reinforcing of successive slip formed components of a unitary composite.

Up to now, the standard or generally accepted techniques for the fabrication of reinforce concrete structures, such as bridge coping for an overpass on the highway, have required either the use of a pre-cast coping element (fabricated off-site), and/or the manual casting of a coping on-site, utilizing traditional forms and concrete casting techniques. In the case of a pre-cast concrete coping element, the road bed of the overpass requires special preparation since the pre-cast element does not readily conform to the angle of incline or grade of a ramp or overpass and, therefore, imperfectly abut one another upon placement on the incline of the bridge overpass. Accordingly, additional installation expense is required to insure the connection of abutting pre-cast copings to one another to insure the formation of a unitary coherent structure.

Alternatively, the on-site casting of an overpass/bridge coping, using the a manual process for forming the coping, specifically, traditional forms and concrete casting techniques, is preferably to the pre-cast coping, because the resulting coping is structurally continuous, and better conforms to the incline/grade of the ramp or overpass. Notwithstanding, the on-site casting of a bridge coping, by traditional concrete casting techniques, is very labor intensive and does not, without an inordinate amount of man power, lend itself to rapid fabrication and accelerated completion schedules. Current building specifications do not, however, generally permit the use of either technique for the formation of concrete structures having rebars extending from within the formed component because of the inability to integrate the rebars embedded within the concrete structures, with the rebars which extend from the concrete structures.

As is evident from the above, there are number of alternatives for the slip forming of structures for use in road and bridge construction. The numerous alternative systems have their proponents and their detractors. In the context of selection of the more appropriate and efficient system, for example, for construction of various road way structures, such as bridge copings, road bed pads, retainer/barrier walls and/or glare shields, time is money, and often is reflected in the bidding process. More specifically, the bid letting on highway construction projects routinely include both penalty provisions for tardy completion and/or bonus payments for early completion. Accordingly, efficiencies which advance project completion, generally translate into both cost saving and increased profits. Thus, there are continuing efforts to automate, where possible, the method for the fabrication of structural concrete components in highway construction; and, thereby standardize the method for the fabrication of certain roadway construction components. This is particularly appropriate in the case of roadway construction being bid and undertaken on an interstate and/or federally funded highway construction projects.

Slip forming is one such advancement (standard), which been adopted for reducing manual/traditional concrete casting of structural highway components fabrication of a limited number of concrete structures, (e.g. Jersey barrier). This process has, however, remained relatively unchanged for more than 35 years; and, unfortunately has been limited to forming of structures which do not readily lend themselves to further integration with additional, complementary components.

OBJECTIVES OF THIS INVENTION

It is the object of this invention to remedy the above, as well as related deficiencies, in the prior art.

More specifically, it is the principle object of this invention to provide an improved method and system for forming of reinforced composite concrete structures utilizing a series of tunnel molds for the sequential slip forming of functionally discrete components of a composite, with each such component having and/or providing reinforcement to a proximate component of such composite.

It is another object of this invention to provide an improved method and system for forming of reinforced composite concrete structures utilizing a series of tunnel molds for the sequential slip forming of functionally discrete components of a structural composites having at least a portion of its reinforcement from an antecedent slip formed component of the composite.

It is yet another object of this invention to provide an improved method and system for forming of reinforced composite concrete structures utilizing a series of tunnel molds for the sequential slip forming a bridge coping having exposed rebars and a slip formed traffic rail, wherein at least a portion of the traffic rail reinforcement is provided by exposed rebars which extend from within an antecedent slip formed component of the composite.

It is still yet another object of this invention to provide an improved method and system for forming of reinforced composite concrete structures utilizing a series of tunnel molds for the sequential slip forming a traffic rail having exposed rebars and a barrier wall, wherein at least a portion of the barrier wall reinforcement is provided by exposed rebars which extend from within the slip formed traffic rail.

Additional objects of this invention include the provision of improved reinforced composite concrete structures having a plurality of functionally discrete components wherein at least a portion of the reinforcement from each functionally discrete component is incorporated into and integral with each contiguous functional component, so as to form a monolithic composite structure.

SUMMARY OF THE INVENTION

The above and related objects are achieved by providing a series of tunnel molds for the sequential slip forming of a structural composite composed of functionally discrete components, wherein each functionally discrete component of the composite has at least a portion of its reinforcement, in common with the reinforcement from an antecedent slip formed component of the composite. By way of example, the system and method of this invention is useful in forming of a reinforced, monolithic, composite structure including

- a bridge coping component,
- a traffic rail component, and
- a barrier wall (the term "barrier" being understood to connote a physical "visual" barrier and/or "sound" or "noise" barrier and/or an "impact" barrier, which is resistant displacement upon collision by a motor vehicle), by the continuous, sequential slip forming, in order, of the each of the foregoing components of this composite, on a prior slip formed, or antecedent, component having exposed rebars. More specifically, each antecedent slip formed component is reinforced with an array of reinforcing materials, (rebar cage or array), wherein at least a portion of the array of reinforcing materials is embedded within the slip formed component, and a portion of the reinforcing materials is essentially free of concrete, and extend from within the slip formed component. These reinforcing materials (rebars), which extend from within the slip formed antecedent component, are typically spliced with additional reinforcing materials, depending upon the needs of the structural demands upon additional component of the composite, for reinforcement and integration into a successive component of the composite. The last to be formed component of a completed composite does not usually require that a portion of the reinforcing materials for this last to be formed component to remain essentially free of concrete, and/or extend from within the last to be formed component.

In an alternative embodiment of this invention, the last to be formed component of this completed composite structure, (e.g. barrier wall), can be formed by traditional case-in-place (CIP) techniques, wherein forms are erected upon an antecedent component of the composite having the exposed rebars, and thereafter concrete poured into such forms in the traditional manner.

Preliminary to initiation of slip forming of the composite of this invention, an array of reinforcing steel is assembled, (also "rebar cage" or "iron work array"), and positioned/aligned relative to the path (e.g. road bed) where the concrete structure is to be formed. The rebar cage on this path includes both steel reinforcing bars which are to be embedded within the first component part of a reinforced a slip formed concrete structure, and steel reinforcing bars which are to extend from within the first component part of the slip formed concrete structure. The configuration of this iron work array, specifically the position and height of the steel reinforcing bars, which are to extend from within the first component part of the slip formed concrete structure, coincide with the location and height of the channel(s) which run through the tunnel mold. Accordingly, as the tunnel mold is progressively advanced over the iron work array, quick set concrete covers the steel reinforcing bars of the iron work array within the mold cavity, while the steel reinforcing bars of the iron work array, which are to extend from the rebar cage within the slip formed concrete structure, are permitted to pass through the tunnels through the mold cavity essentially concrete free. The slip formed component produced in accord with the system will, thus, have a portion of the steel reinforcing bars of the iron work array embedded within the slip formed structure, and a portion of the steel reinforcing bars of the iron work array extending from within the slip formed structure, for the later reinforcement and integration within yet another component of the composite.

In one of the preferred systems of this invention, the exposed reinforcement (rebars) from an antecedent functionally discrete component of a composite, is integrated/spliced to additional reinforcing materials, (if needed), prior to the slip of the next component in this composite. Where this system contemplates slip forming the composite having multiple functionally discrete components, each of the slip formed functionally discrete component will have exposed rebars, and, thus, require a tunnel model specific for forming the next or successive component of the composite. For example, after a bridge coping is formed with exposed rebars, the sequential slip forming of a traffic rail requires a tunnel mold specific for this discrete traffic rail component. To the extent yet another successive functionally discrete component is contemplated for this composite, (such as is appropriate for fabrication of a barrier (sound or impact resistant) wall), a barrier wall component can be successively formed upon and integrated with the traffic rail. Where the barrier wall component completes the composite, it is typically formed without extending rebars.

In one of the preferred embodiments of this invention, the slip mold for forming a specific component of the composite, such as a bridge coping, comprises a mold cavity for forming a coping for integration of an MSE ("Mechanically Stabilized Earth") wall and a road bed pad. In this preferred embodiment of the invention, the slip-mold also includes a series of vibrators positioned within the mold cavity for consolidation of the concrete within the mold cavity, as the slip-mold is progressively advanced over an iron work array. In this embodiment of the invention, the vibrators are positioned to insure consolidation of the concrete within the mold at the margins of the slip formed concrete structure, and proximate to the tunnels through the housing. In each instance, the vibrators provide for a consolidation of the concrete within the slip-mold, and, thus, both an enhanced (smooth) finish to the surface of the concrete structure, and improved adhesion of the concrete to the iron word array embedded therein.

In this system and method of this invention, the tunnel mold comprises a housing having (a) a hopper for receiving and distributing quick set concrete from a source of quick set concrete, into a mold cavity, and (b) a mold cavity for forming a reinforced concrete structure having rebars both embedded with a said reinforced concrete structure and rebars extending from within said reinforced concrete structure. The consolidation of the unset concrete within the mold cavity, proximate to the tunnels through the slip-mold, both increases the density of the concrete at the base of these tunnels, and can force the unset concrete, if not adequately consolidated, from the mold cavity into these tunnels, as the mold passes over the iron work array. In order to minimize the migration of unset concrete into the tunnels from the mold cavity, (prior to the adequate consolidation of the concrete), a series of fins are provided, which extend downward from each defining wall of the tunnels, into the unconsolidated concrete in mold cavity. The depth of penetration of the fins into the unconsolidated concrete in the mold cavity is related to the relative time it takes for the concrete to begin to consolidate, the proximity of the vibrators to the tunnels in the mold and the rate of movement of the tunnel mold over the iron work array. The design of these fins, (e.g. depth of penetration of the fin, and the length), can be estimated fairly accurately based upon the foregoing factors. The selected design configuration for these fins is also based upon the ambient conditions prevalent at the time of the slip forming. The selected fin design configuration is effective to inhibit the migration of unconsolidated concrete into each of the tunnels of the mold, thereby preventing concrete from covering the rebars, which extend from the iron work array into these tunnels. For example, if the slip formed reinforced concrete structure is to have 2 to 3 inches of concrete "cover", these fins can extend from the upper surface of the mold cavity, down into mold cavity, to a depth of the rebar cage, which is embedded within the slip formed reinforced concrete structure (2 to 3 inches into the mold cavity). Accordingly, the rebars passing through these tunnels, remain essentially concrete free as the slip mold progressively advances over the iron work array during the slip forming process.

In the preferred embodiments of this invention, one or more of the vibrators can extend into the mold cavity to a depth sufficient to contact the iron work array, as the tunnel mold is progressively advanced over such array. In this preferred embodiment of the invention, the vibrators are maintained at a forward inclined angle, relative to the iron work array, so as to pass over the iron work without become entangled in the array. At least some of these vibrators are strategically positioned at the lateral margins of the mold cavity to insure compaction of concrete at these exposed surfaces of the slip formed structure and a smooth (dense) surface appearance.

DESCRIPTION OF THE INVENTION INCLUDING PREFERRED EMBODIMENTS

Figure 1:
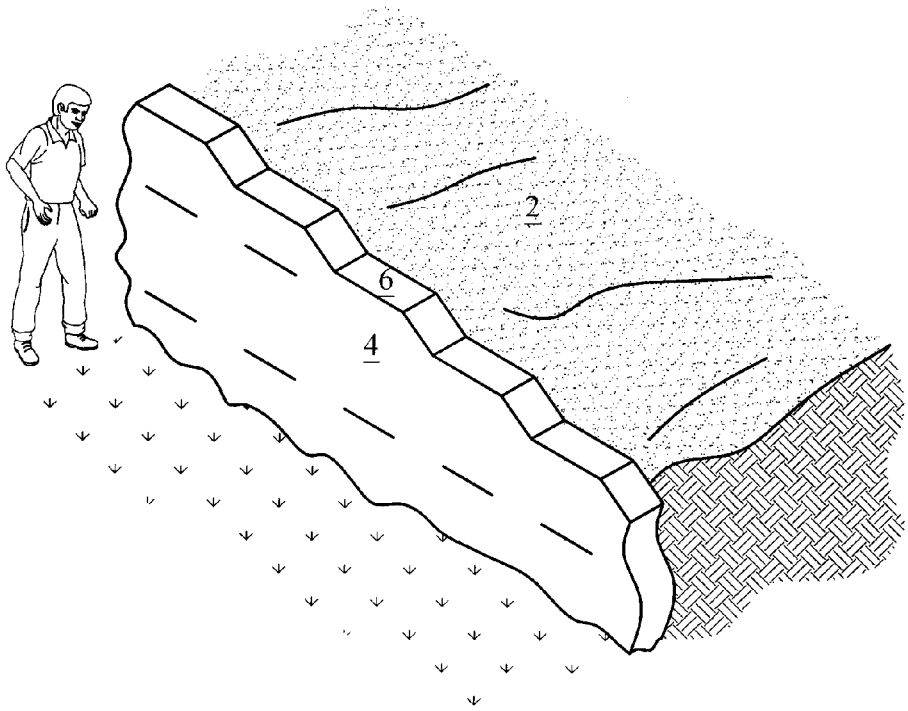
FIG. 1 depicts a perspective view of an inclined road bed, which has yet to be prepared for the addition of a concrete coping or concrete road pad.

As understood within the context of this invention, the following terms and phrases are intended to have the following meaning unless otherwise indicated.

Glossary of Terms

The phrase "slip forming", or "horizontal slip forming", is intended, and used herein, to describe a construction method in which concrete is poured into a continuously moving form ("slip mold"). Slip forming is used for tall structures (such as bridges, towers, buildings, and dams), as well as horizontal structures, such as roadways. Slip forming enables continuous, non-interrupted, cast-in-place "flawless" (i.e. no joints) concrete structures, which have superior performance characteristics to piecewise construction, using discrete form elements. Slip forming relies on the quick-setting properties of concrete, and requires a balance between quick-setting capacity and workability. Concrete needs to be workable enough to be placed into the form and consolidated (via vibration), yet quick-setting enough to emerge from the form with strength, (also "green strength"), sufficient to be self-supporting because the freshly set concrete must not only permit the form to "slip" forward but also support the freshly poured concrete which now abuts it, as the form continues to move forward.

The phrase "slip mold" is intended and used herein, to describe a mold used in the slip forming of a continuous concrete structure (preferably reinforced with iron work) with quick setting concrete. The slip mold is mounted on a movable conveyance which positions the slip mold over an essentially continuous reinforcing concrete cage. Concrete is poured into the mold, while the mold is progressively advance over the cage.

The phrase "tunnel mold" is intended, and used herein, to describe a unique slip-mold having a one or more tunnels or channels through the mold. Each of these tunnels or channels has an open end in communication with the mold cavity, and is of a sufficient height to accommodate the passage of concrete free rebars, which extend into these tunnels or channels from the iron work array, within the mold cavity, as they pass through such tunnels or channels. The slip formed structure which emerges from the tunnel mold, thus, has both rebars embedded in the concrete in the mold cavity, and rebars which remain essentially concrete free, which extend from this slip formed reinforced concrete structure, as it emerges from the mold cavity.

The term "rebar" (short for "reinforcing bar"), is intended, and used herein, to describe a steel bar that is commonly used as a tensioning device in reinforced concrete, and in reinforced masonry structures, to strengthen and hold the concrete in compression. It is usually in the form of carbon steel bars or wires, and the surfaces may be deformed for a better bond with the concrete. Within the context of this invention, can be present in the of the form of an iron work array, embedded with a slip formed concrete structure and/or extend from within a slip formed concrete structure. In addition the term rebar, in a number of embodiments of this invention, includes the reinforcement that is spliced to rebars which extend from an iron work array which has been embedded within an antecedent slip formed structure.

The term "composite" is intended, and used herein, to describe a reinforced, monolithic, structure having multiple functional components, wherein each component of the composite is formed sequentially, preferably by slip forming with a tunnel mold, upon an antecedent component of the composite, and incorporates reinforcement (exposed rebars) from an antecedent component into each successively formed component.

The phrase "road pad' is intended, and used herein, to describe and connote a structural roadway component of a composite, such as a slip formed concrete (monument or junction) slab, which is preferably formed concurrent with the bridge coping. The road pad can used in conjunction with a bridge coping, to delineate the lateral margins of the road bed, and is subsequently integral with the road bed.

The term "coping" or phrase "bridge coping" is intended, and used herein, to describe and connote a structural roadway component of a composite which is affixed and preferably integral with the top of a retaining wall, (e. g. MSE retaining wall), of an elevated roadway. Within the context of this invention, "coping" and "bridge coping" can be formed concurrent with a road pad. In this component of the composite, the slip formed structure has rebars both extending from within and partially embedded within the slip formed coping. The slip formed coping prepared in accordance with the process of this invention is, thus, unique in terms of its fabrication history.

The phrase "traffic rail" is intended, and used herein, to describe and connote a structural roadway component of a composite which is integral with, and formed upon an antecedent structural component, such as bridge coping or road pad (monument or junction slab). A "traffic rail" typically defines the edge of a road way, and provides some limited protection for preventing vehicles from the departing the road way. Within the context of this invention, at least a portion of the reinforcement from the antecedent structural component of the composite, extends from such antecedent component, and is used to reinforce the traffic rail. A "traffic rail" is typically about 2.5 to 3.0, in height, and can be higher, especially when the function thereof contemplates it being component part in the progressive fabrication of barrier wall.

The phrase "barrier wall" is intended, and used herein, to describe and connote a structural roadway component of a composite which is integral with, and formed upon an antecedent structural component, such as a traffic rail. The characterization of the a wall as a "barrier" is inclusive of its application/function as (a) a so-called "noise" wall, to attenuate traffic noise from a roadway from intruding into a contiguous residential area; (b) a so-called "opaque" wall, to visually mask or hide a roadway from a contiguous roadway or residential area; and (c) a so-called "collision resistant" wall, to restrain a vehicle from leaving the roadway and/or from impact to a structural component of an overpass or bridge support, upon contact/collision with such "collision resistant" wall. Within the context of this invention, at least a portion of the reinforcement from the antecedent structural component of the composite (e.g. traffic rail), extends from such antecedent component, and is used to reinforce the barrier wall. A "barrier wall" of the composite of this invention is typically about 2 to 12 feet, in height, either independent of, or when combined with an antecedent component, such as a traffic rail.

The abbreviation "MSE" is intended, and used herein, to describe Mechanically Stabilized Earth, constructed with artificial reinforcing. MSE walls stabilize unstable slopes and retain the soil on steep slopes and under crest loads. The wall face is often of precast, segmental blocks, panels or geocells, which can tolerate some differential movement. The walls are in-filled with granular soil, with or without reinforcement, while retaining the backfill soil. Reinforced walls utilize horizontal layers typically of geogrids. The reinforced soil mass, along with the facing, forms the wall.

Highway Construction Environment—The tunnel mold concept of this invention is illustrated within the context of the slip forming of reinforced concrete structure for road, bridge, and highway barrier construction. Accordingly, the following description and accompanying illustration depict the tunnel mold and slip forming concept, as applicable to this road, bridge and highway construction environment. In the description of the preferred embodiments of this invention, as illustrated in accompanying patent drawings, where an element or feature in one or more Figures is common to more than one of the accompanying patent drawings, it is assigned the same reference numeral for ease of understanding and simplicity of expression.

FIG. 1 is a perspective view of an inclined road bed (2) for an overpass. As is evident from this illustration, the angle of incline (ascent), and decline (descent), of the road bed can vary with the grade, and, thus, the preferred method for the fabrication of structural components associated with such inclined road bed are best resolved with on-site fabrication of the structural bridge and road elements. Within the context of this invention, the focus is upon the integration of the structural components for a roadway by means which eliminate intensive manual labor, and provide for the sequential formation of bridge and overpass components by means of slip forming. The road bed (2) shown in this FIG. 2 has an incline which has been stabilized by MSE retaining wall (4). The MSE retaining wall (4) shown in FIG. 2 has an unfinished top edge (6), which needs to be integrated into the road bed (2). This integration typically requires the formation of a coping or a comparable structural element, along the unfinished top edge (6) of the MSE retaining wall (4), which, in turn, is further integrated into the finish road bed (not shown).

Figure 2:
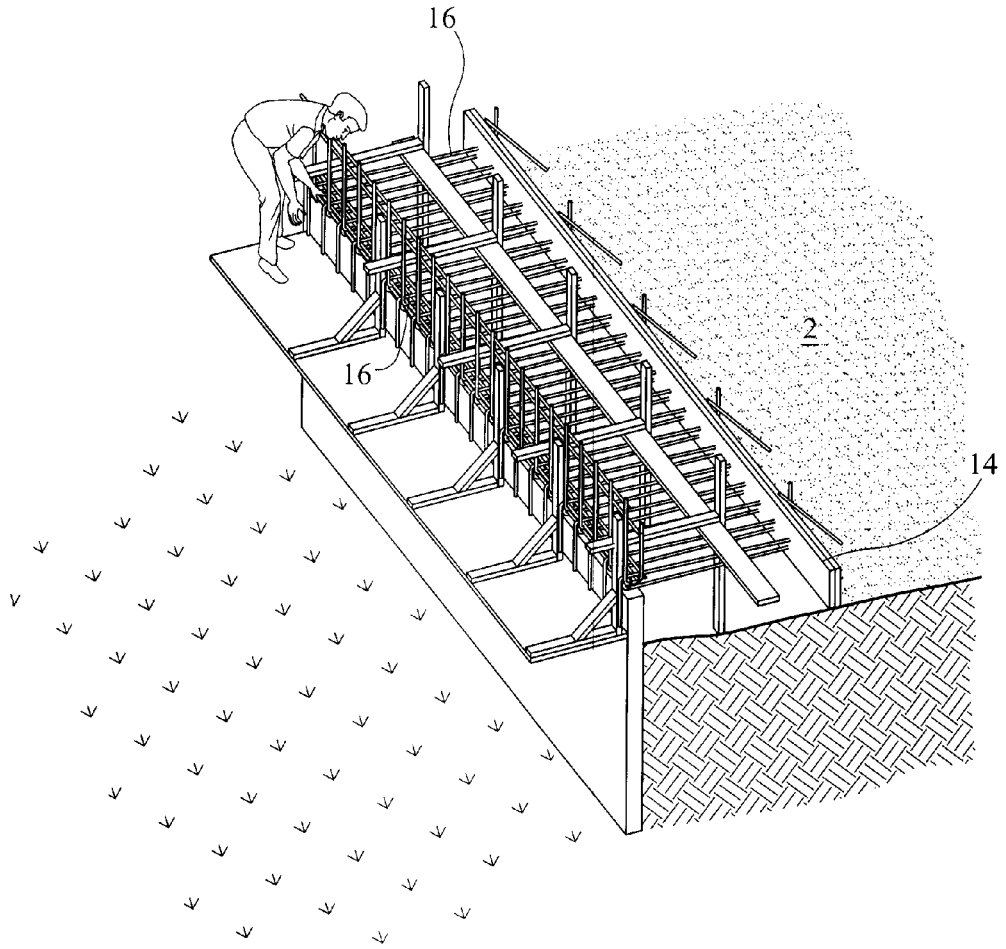
FIG. 2 depicts a perspective view of the custom fabricated forms used in the on-site framing of a coping and road bed pad preliminary to the manual casting of a coping and road bed pad by traditional concrete casting techniques.

FIG. 2 is a perspective view of the traditional, manual on-site preparation for casting of a bridge coping and road pad onto a road bed (2) by conventional concrete casting techniques. In the manual on-site casting of a bridge coping and road pad, extensive manual preparation is required to initially frame a series of forms (14). These forms (14) are used to confine a concrete pour onto an array of iron work or reinforcing steel (16). After the cast concrete sets up, the workers thereafter breakdown the forms; and, this manual process repeated for an additional length of coping, until the job is completed. In a typical road construction environment, this process is labor intensive, time consuming, inefficient and very slow because the typical road crew can only fabricate about 40 to 50 feet of traditionally cast product per day. Obviously, the employment of additional manpower on the job will advance the construction schedule somewhat, but is prohibitively expensive and uncompetitive.

Figure 3A:
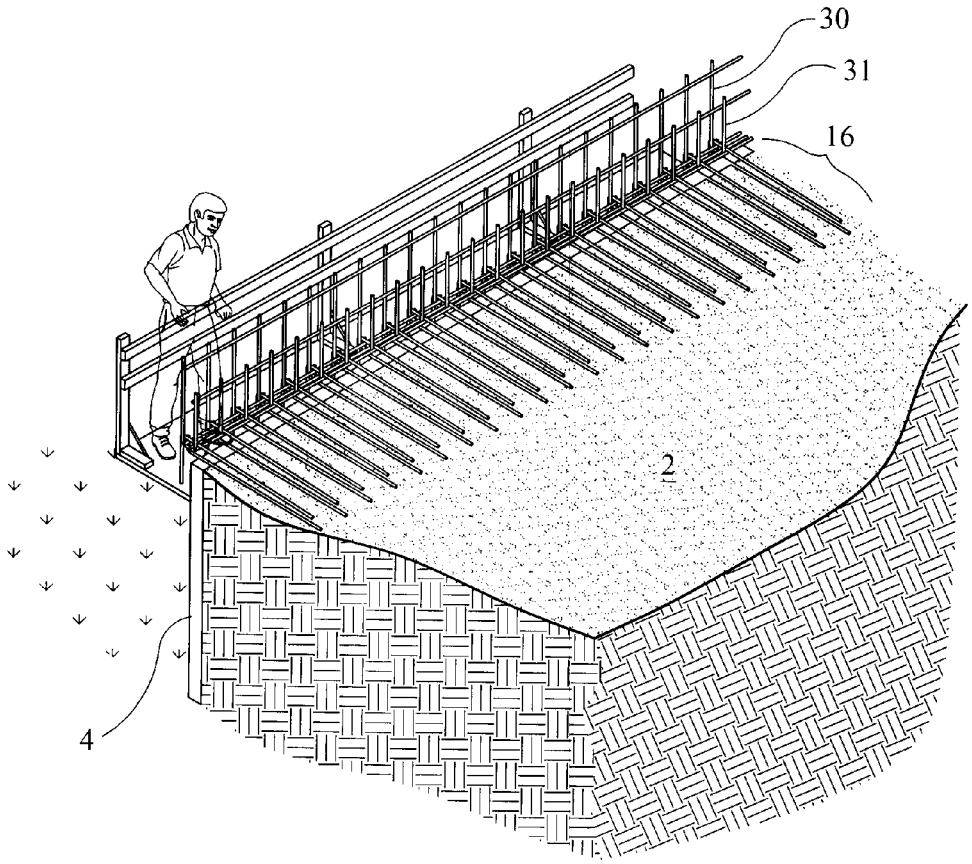
FIG. 3(A) depicts a perspective view of the iron work array on an inclined road bed, prior to the concurrent slip forming of a bridge coping and road bed pad.

FIG. 3(A) depicts a perspective view of the layout of the iron work array (16) for the slip forming of coping and road bed pad upon an inclined road bed similar to the similar inclined road bed (2) as in FIG. 2. As is evident, the preparation for the slip forming of a coping a road bed pad does not require the use of the tradition series of forms (14). It is emphasized, that the placement of the ironwork array (16) is arrange along the road bed (2) proximate to the MSE retaining wall (4) without structure defining elements (forms). The ironwork array (16) can, and is often fabricated on-site; and, its placement determined by a series of surveyor/reference lines (not shown).

Figure 3B:
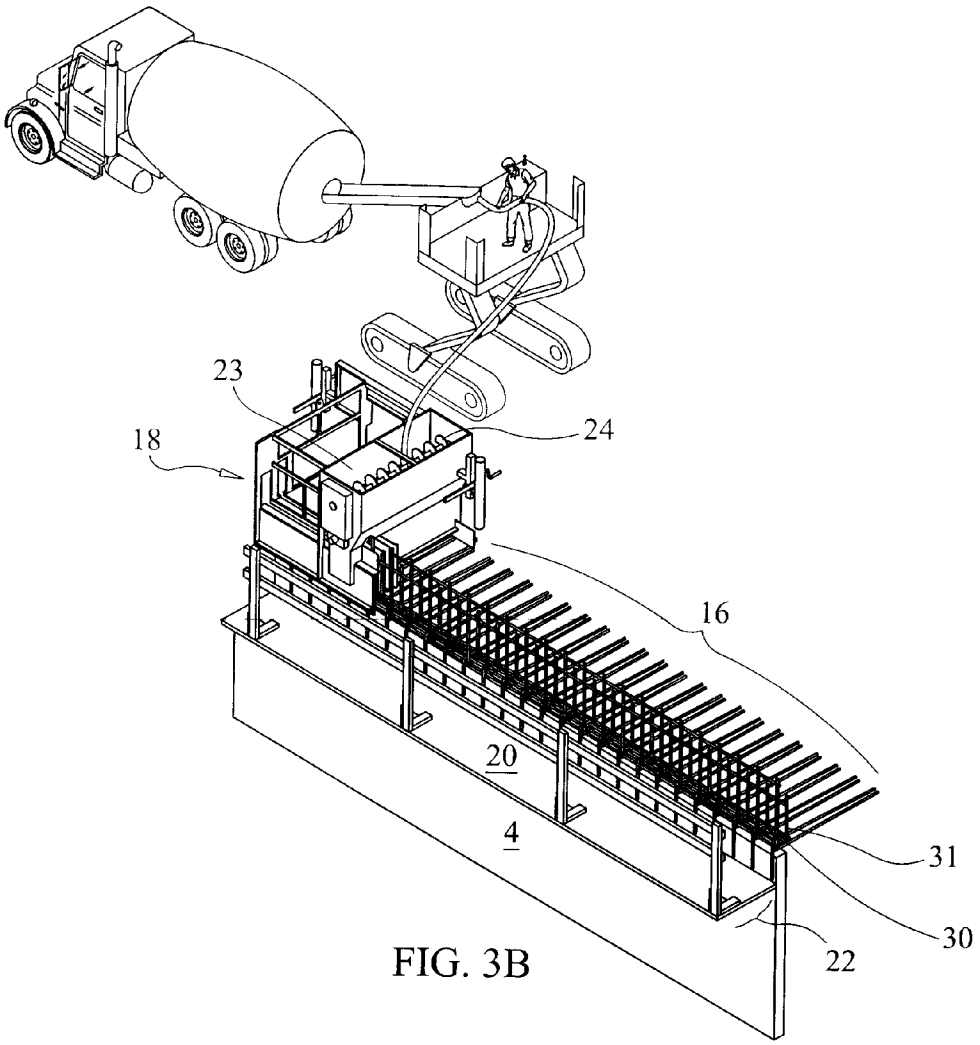
FIG. 3(B) depicts a perspective view of the tunnel mold assembly of this invention, in relation to the iron work array of FIG. 3(A).

FIG. 3(B) depicts placement of a tunnel mold (18), (also herein the "first tunnel mold"), preliminary to the slip forming of a coping and road bed pad upon the ironwork array (16) of FIG. 3A. FIG. 3(B) shows the iron work array (16), in respect to the MSE retaining wall (4), and a platform (20) which has been erected along the outside (exposed side) of MSE retaining wall (4) to allow for worker oversight of the slip forming process, and to provide a support (22) for a coping along the top of the MSE retaining wall (4). More specifically, the platform (20) is positioned, relative to the iron work array (16), and to the top of the MSE retaining wall (4), so as to provide a base for a coping, which is to extend over the top of the MSE retaining wall (4). In this FIG. 3(B), the tunnel mold (18) is shown to have an open hopper (25) positioned above a mold cavity (23) of the tunnel mold (18).

Figure 3C:
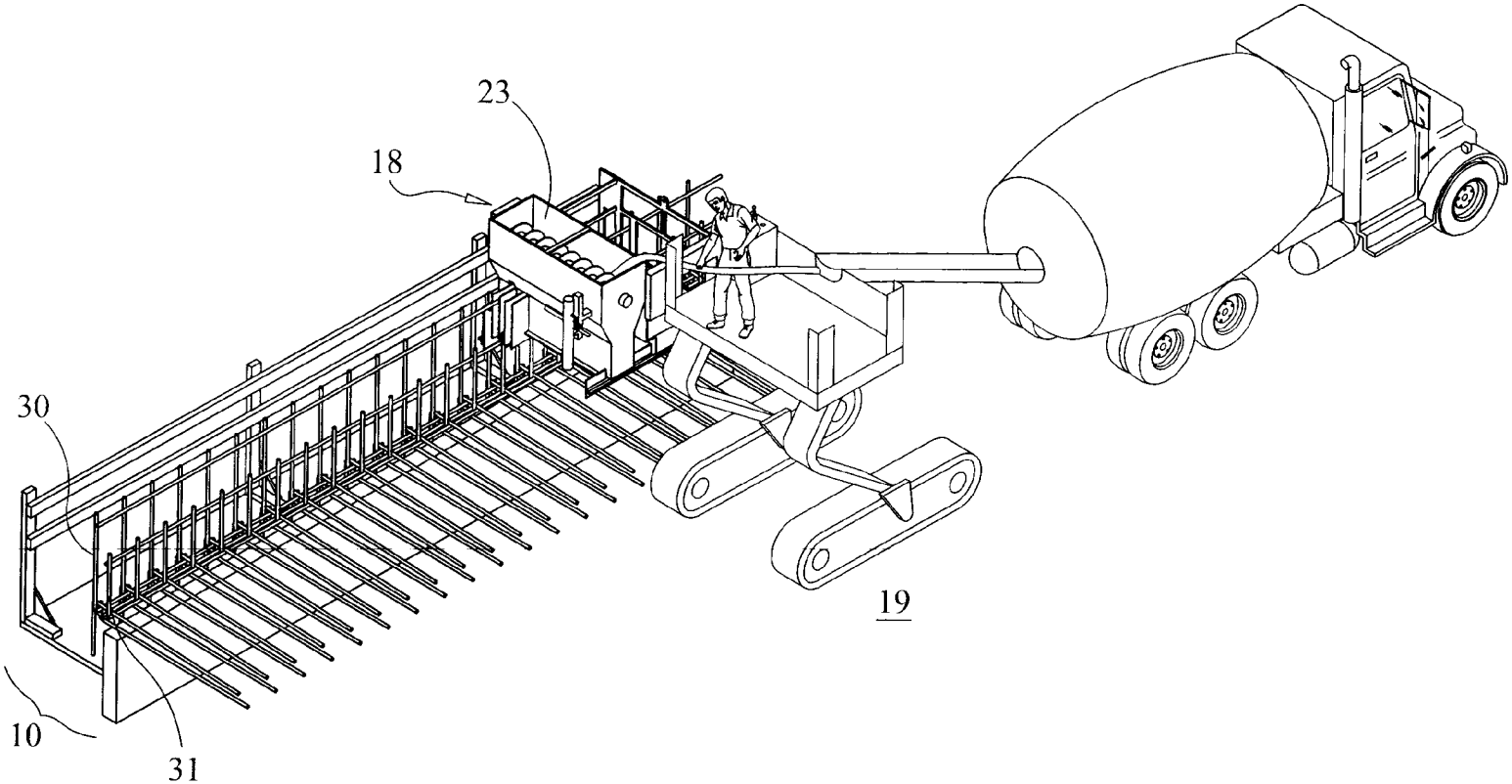
FIG. 3(C) depicts slip forming machinery of this invention in relation to an iron work array of FIG. 3(A).

FIG. 3(C) depicts the (first) tunnel mold (18) in combination with slip forming support assembly (19) typically associated therewith. In FIG. 3(C), ready mix concrete is conveyed from a cement mixer to a slip forming support assembly, incorporating a tunnel mold (18), mounted on a transport (19). A workman is shown dispensing the relatively fluid concrete mix into the hopper (25) of the tunnel mold (18). The assembly includes both well-known means for guidance of the assembly relative to the iron work arrays; and, for modulation of the speed of the assembly.

Figure 4A:
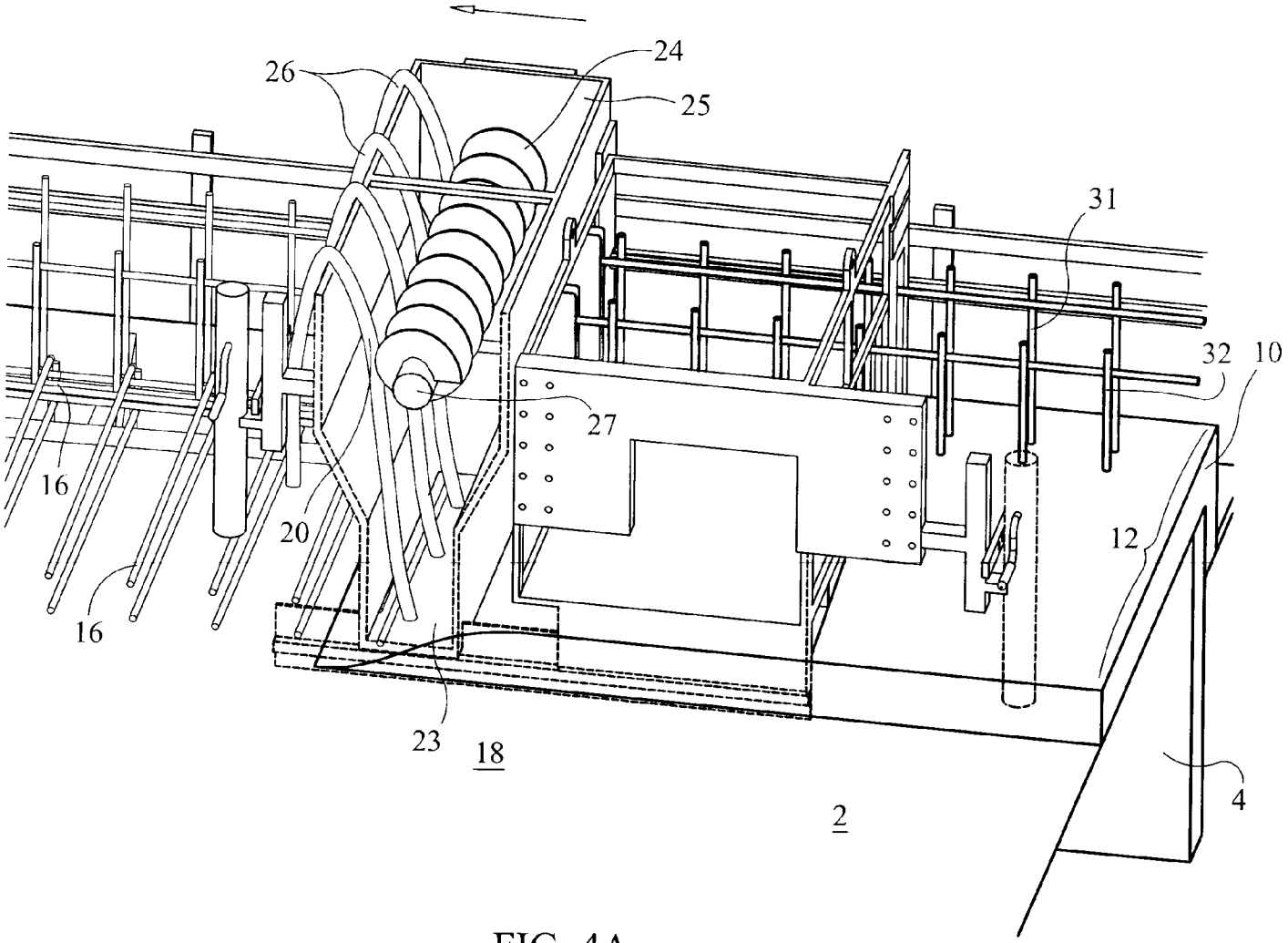
FIG. 4(A) is an enlarged view, (in partial cut away), of the tunnel mold of FIGS. 3(B) & (C), when viewed from the side of the tunnel mold proximate to the road bed (2).

FIG. 4 (A) is an enlarged view, (in partial cut away), of the tunnel mold (18) of FIGS. 3(B) & (C), when viewed from the side of the tunnel mold (18) proximate to the road bed (12). In FIG. 4(A), the auger (24) is disposed within a hopper (25) positioned above a mold cavity (23) of the tunnel mold (18). A series vibrators (26) extend into the tunnel mold (18), through the hopper (25) and down into the mold cavity (23). Upon the dispensing of a ready mix concrete (not shown) into the hopper (25) of the tunnel mold (18), the concrete gradually fills the hopper (25), and the mold cavity (23), until it completely covers the auger (24). The auger (24) is driven by a drive motor (not shown), which rotates an auger drive shaft (27), and thereby effects rotation of the auger and distribution of the concrete across the width the hopper (25) and mold cavity (23). In practice, and during the operation of the slip forming process, the tunnel mold (18) is progressively advanced over the ironwork array (16) of FIG. 3A (from left to right), as a slip formed, concrete coping (10) and a road bed pad (12), are formed upon the iron work array (16). A series of vibrators (26) consolidate the concrete within the mold cavity (23) of tunnel mold assembly (18) and thereby compact the concrete and eliminate any voids or lack of continuity within the resultant slip formed structure. This consolidation of the concrete in the mold cavity (23) is essential to the green strength of the concrete coping (10) and a road bed pad (12); and, a prerequisite to the continuous forward movement (slipping) of the tunnel mold assembly from the formed concrete coping (10) and a road bed pad (12), over the iron work array.

Figure 4B:
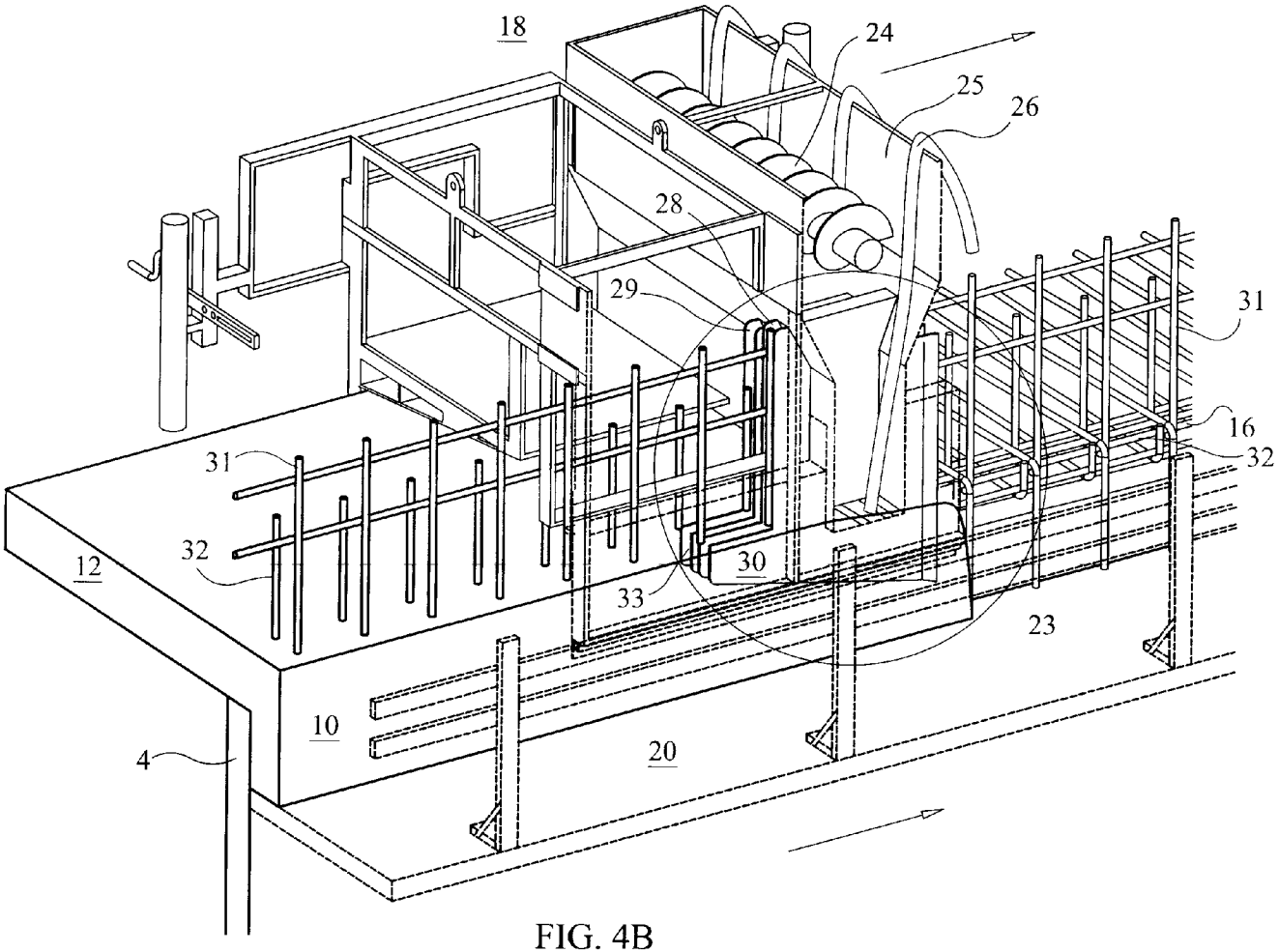
FIG. 4(B) is an enlarged view, (in partial cut away), of the tunnel of FIGS. 3(B) & (C).), when viewed from coping side of the tunnel mold.
Figure 4C:
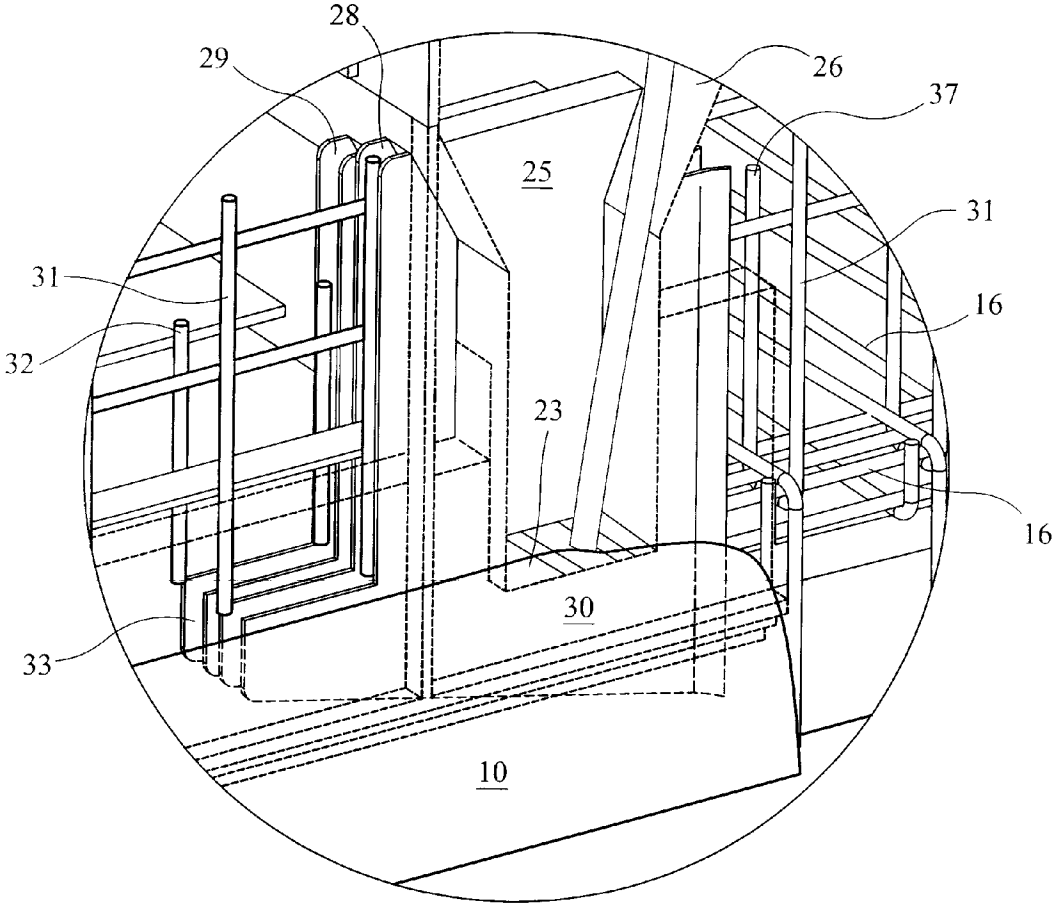
FIG. 4(C) depicts an enlarged view of the area within the circle of FIG. 4(B).

FIG. 4(B) is an enlarged view, (in partial cut away), of the tunnel mold (18) of FIGS. 3(B) & (C).), when viewed from the coping side of the tunnel mold. In FIG. 4(B), the tunnel mold (18) is shown to have two open slots or tunnel (28, 29), for accommodating the passage a pair of rebars (31, 32), through the tunnel mold (18). The design and engineering of the tunnels enables rebars (31, 33), to pass through the tunnel mold (18) during the slip forming of a bridge coping, and yet remain essentially concrete free. This is accomplished by designing each of the tunnels, more specifically, accessories to the tunnels, to inhibit the flow of concrete from the mold cavity into each of the tunnels. More specifically, each of tunnels (28, 29) are further provided with fins (30, 33), which extend from the bottom of each of the defining walls of each tunnels (28, 29), into the concrete in the mold cavity (23), concurrent with the slip forming of the coping (10). These fins (30, 33) are effective to prevent/minimizing the flow of unconsolidated concrete from the mold cavity (23) into tunnels (28, 29). Accordingly, such fins (30, 33) permit the formation of a coping (10) with rebars extending from within the slip formed coping, wherein rebars (31, 32) pass through such tunnels and remain essentially concrete free, FIG. 4(C) depicts an isolated and enlarged view of the fins (30, 33) of FIG. 4(B). In this FIG. 4(B), the fins (30, 33) extend from the tunnels (28, 29) into the mold cavity (23) and, thus, effectively inhibit the unconsolidated concrete from flowing in the tunnels. The fins (30, 33) in this FIG. 4(B) are tapered, and, thus, extend more deeply into the formed coping (10) at the forward or leading edge of the mold tunnel (28, 29). In this FIG. 4(C), the vibrator (26) is proximate to the tunnels (28, 29), thereby consolidating the concrete proximate to these tunnels (28, 29). This consolidation compacts the concrete proximate to the tunnels (28, 29), and, this compacted concrete further impedes the flow of concrete from the mold cavity (23) into the tunnels (28, 29). Accordingly, when the tunnel mold (18) advances forward over the iron work array (16), only the iron work array, within the mold cavity (23), is embedded in concrete, whereas the rebars (31, 32), which pass through the channels (28, 29) remain essentially concrete free. As the tunnel mold (18) moves progressively forward over the iron work array (16), the fins (30, 33) are withdrawn from the coping by the advancing tunnel mold (18), and the concrete within the mold cavity (23) recedes into the fin tracks in the slip formed coping.

Figure 5A:
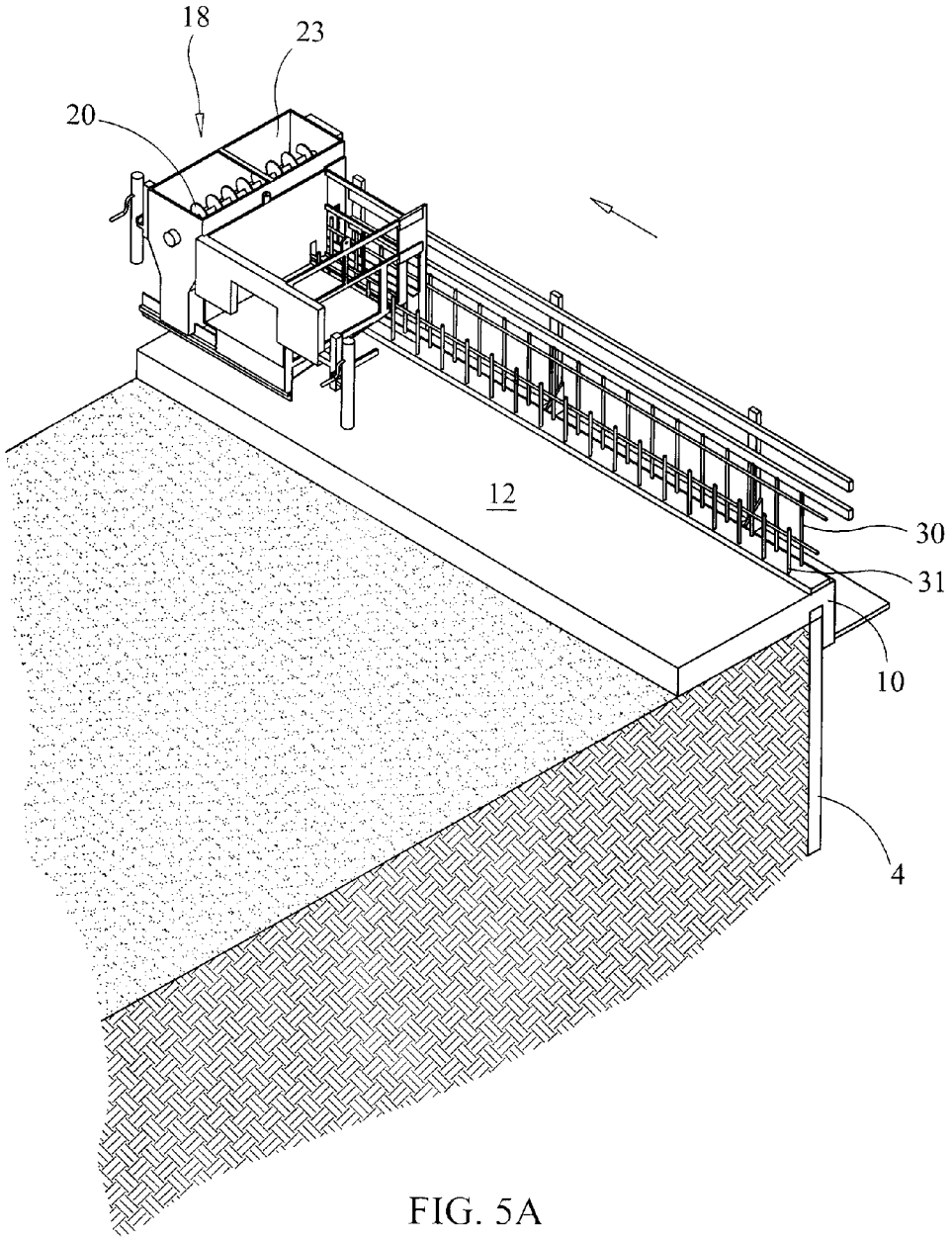
FIG. 5(A) depicts a perspective view of a tunnel mold assembly and slip formed bridge coping and road bed pad, when viewed from the rear of the tunnel mold.

FIG. 5(A) depicts a coping (10) and road pad (12), which have been formed with the tunnel mold (10) of FIG. 4(A) to FIG. 4(C), in accordance the slip forming system and process of this invention. As is evident in FIG. 5(A), the coping (10) and road pad (12) have been slip formed as a monolithic structure; and, the coping (10) fully engages the top of the MSE retaining wall (4), so as to mechanically couple the MSE retaining wall (4) to the road (road pad (12)). The coping (10) includes extending rebars (30, 31) which can be used to further integrate the coping (10) with other structural road elements.

Figure 5B:
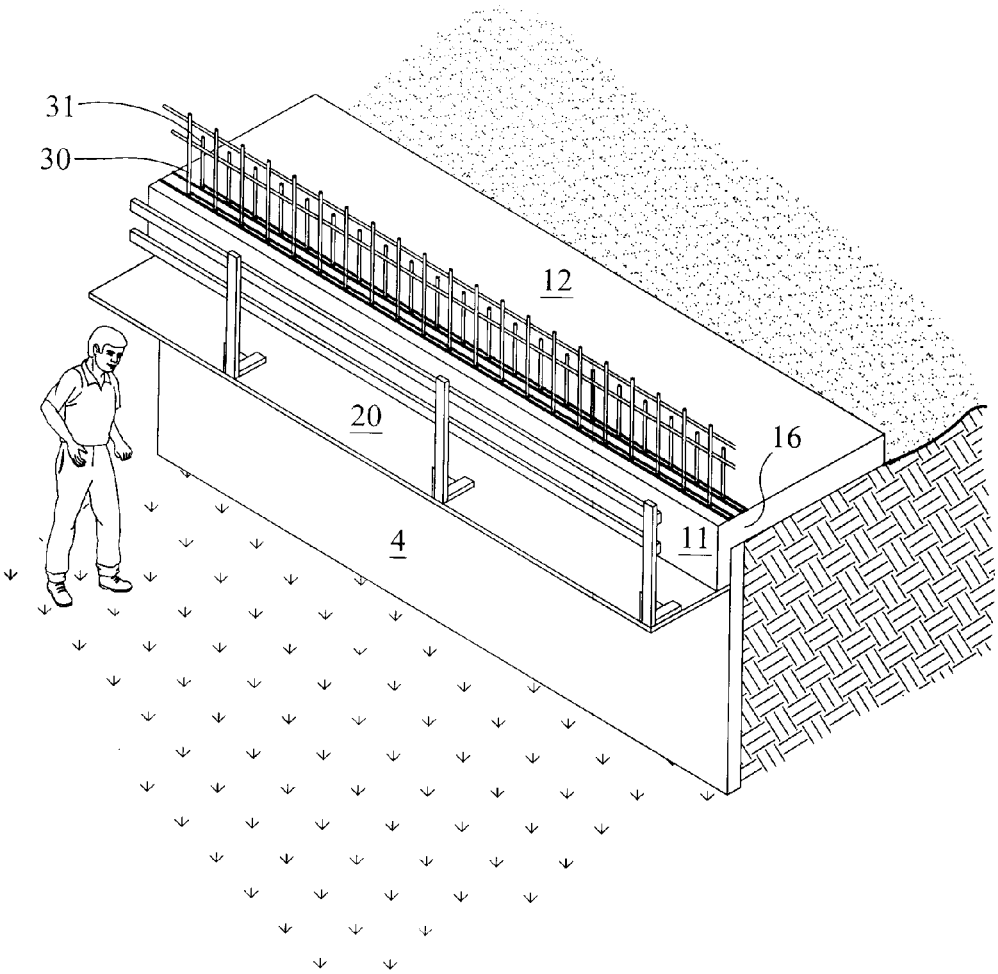
FIG. 5(B) depicts a perspective view of a slip formed bridge coping and road bed pad, when viewed from side of an MSE retaining wall.

FIG. 5(B) depicts a slip formed coping (10) and road pad (12), when viewed from the side of the MSE retaining wall (4). In FIG. 5(B), the coping (10) extends over the top and down the outside of the MSE retaining wall (4), to the platform (20), which had been constructed along the side of the MSE retaining wall (4). In this FIG. 5(B), the platform (20) is shown to have served as a support/form for the base of vertical extension (11) of the coping (10), and thereby, the position of the platform (20) relative to the top of the MSE retaining wall (4), defines the length of the vertical extension (11) of the coping (10) proximate to MSE retaining wall (4).

Figure 6A:
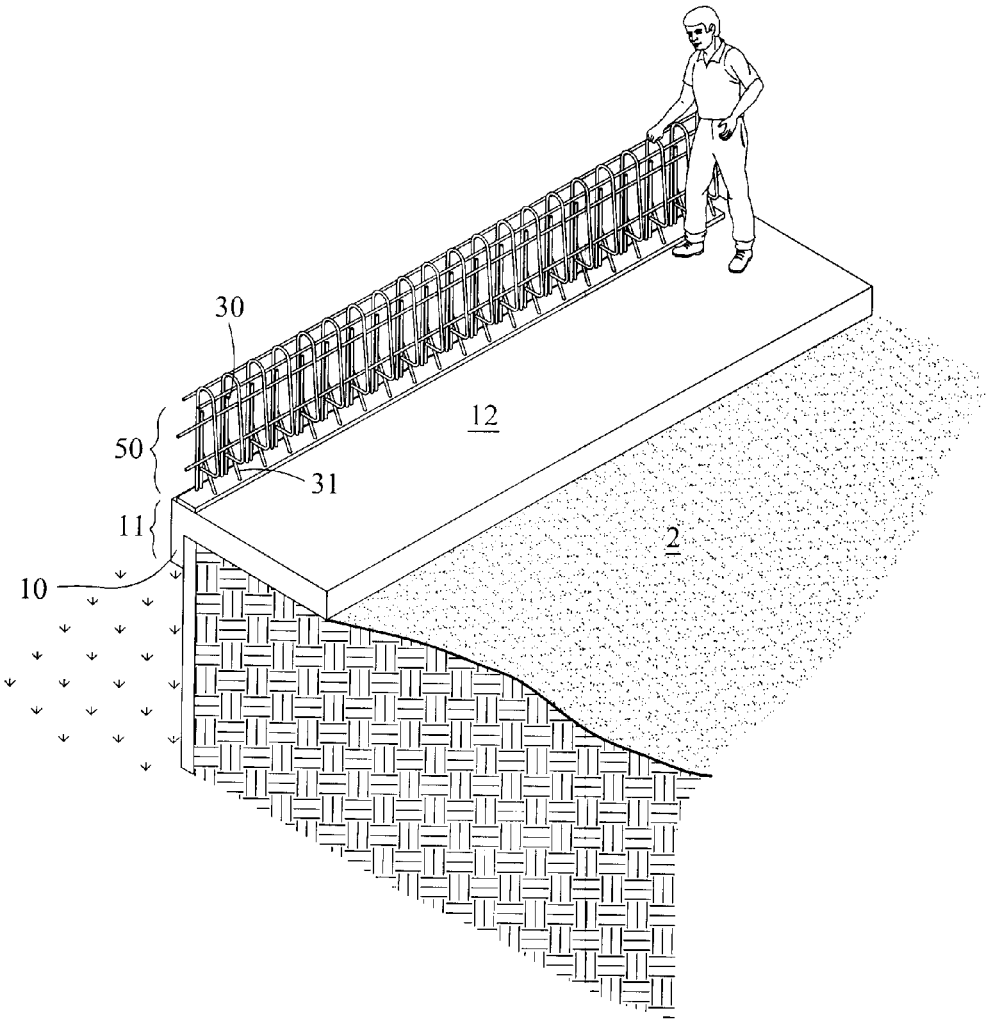
FIG. 6(A) depicts a perspective view of a slip formed bridge coping and road bed pad wherein the extended rebars are physically connected/spliced to additional rebars preliminary to forming of a traffic rail on the bridge coping.

FIG. 6A depicts a perspective view of the layout of an iron work array (50) for a traffic rail (50), which has been placed on top of the slip formed bridge coping illustrated in FIG. 5(A).

Figure 6B:
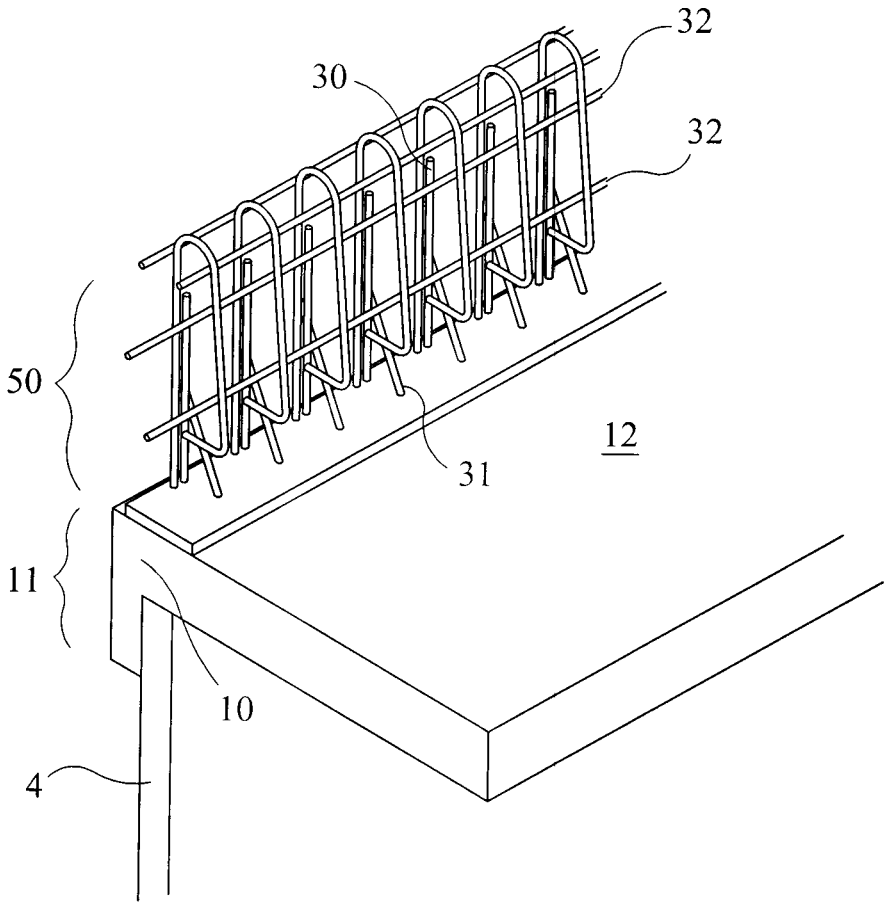
FIG. 6(B) is an enlarged view of the rebars reinforcement of a traffic rail prior to embedding in concrete and the integration thereof with the slip formed bridge coping.

FIG. 6B. depicts an enlarged view of the iron work array (50) for a traffic railing to be formed on top of and integrated with slip formed coping (10) of FIGS. 5B-5H). In order to accommodate their physical connection, rebar (31) has been bent prior to the connection to additional reinforcing steel rods (32). Accordingly, upon slip forming of a retaining wall/barrier, it shall be structurally reinforced with both exposed rebars (30, 31) from the coping (10) and an additional iron work (32) of the array (50) intended for such reinforcement. Thus, the retaining wall/barrier wall, once formed, shall be integrated into the slip formed coping (10).

Figure 6C:
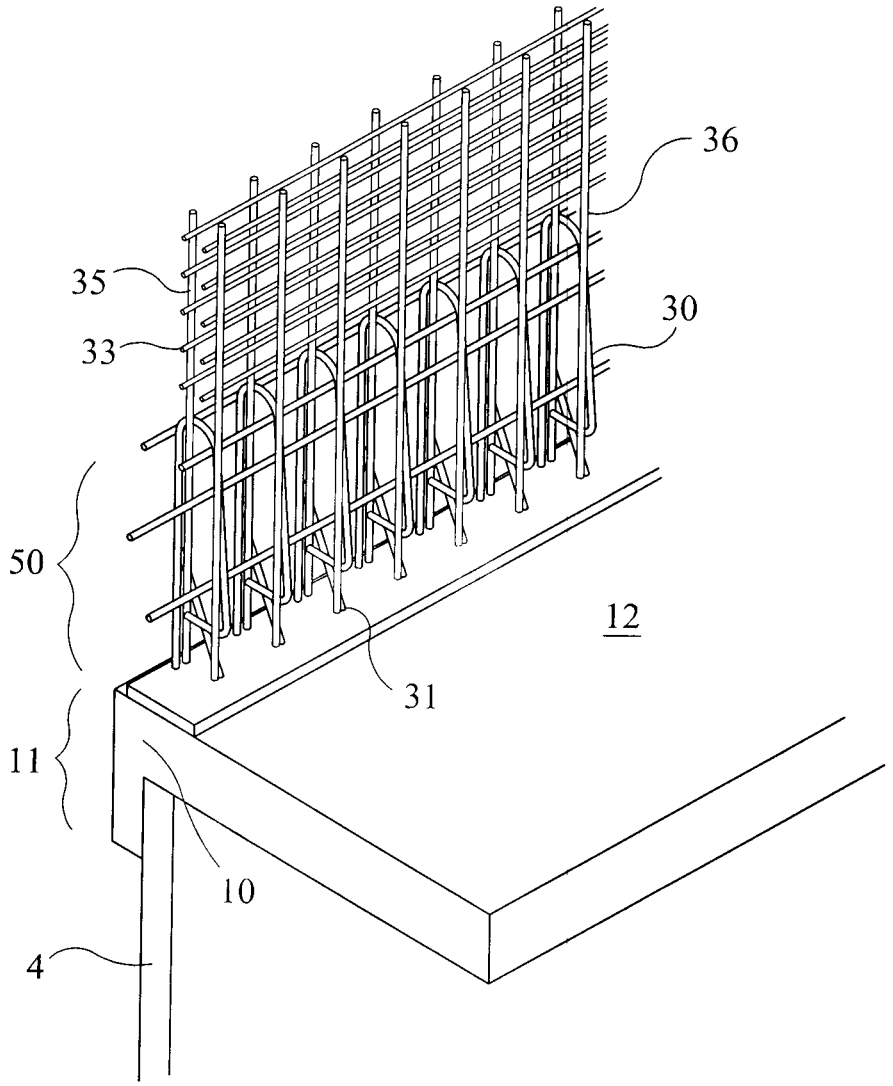
FIG. 6(C) depicts an alternative embodiment of FIG. 6(B) wherein additional rebars are physically spliced to the iron exposed work array for a traffic rail.

FIG. 6C depicts a further modification of the iron work array shown in FIG. 6B More specifically, the iron work array (30, 31) of FIG. 6B is modified by manually splicing additional rebar (34, 35), (not drawn to scale), to the iron work array (30, 31) which extends from within the formed bridge coping (10). These additional rebar (34, 35) of FIG. 6B are contemplated for incorporation into yet another functionally discrete member (e.g. barrier wall extension of traffic rail) of the composite. By forming another functionally discrete member in this manner, the reinforcement of traffic rail/coping/road pad are fully integrated into of another functionally discrete member of this composite.

Figure 7:
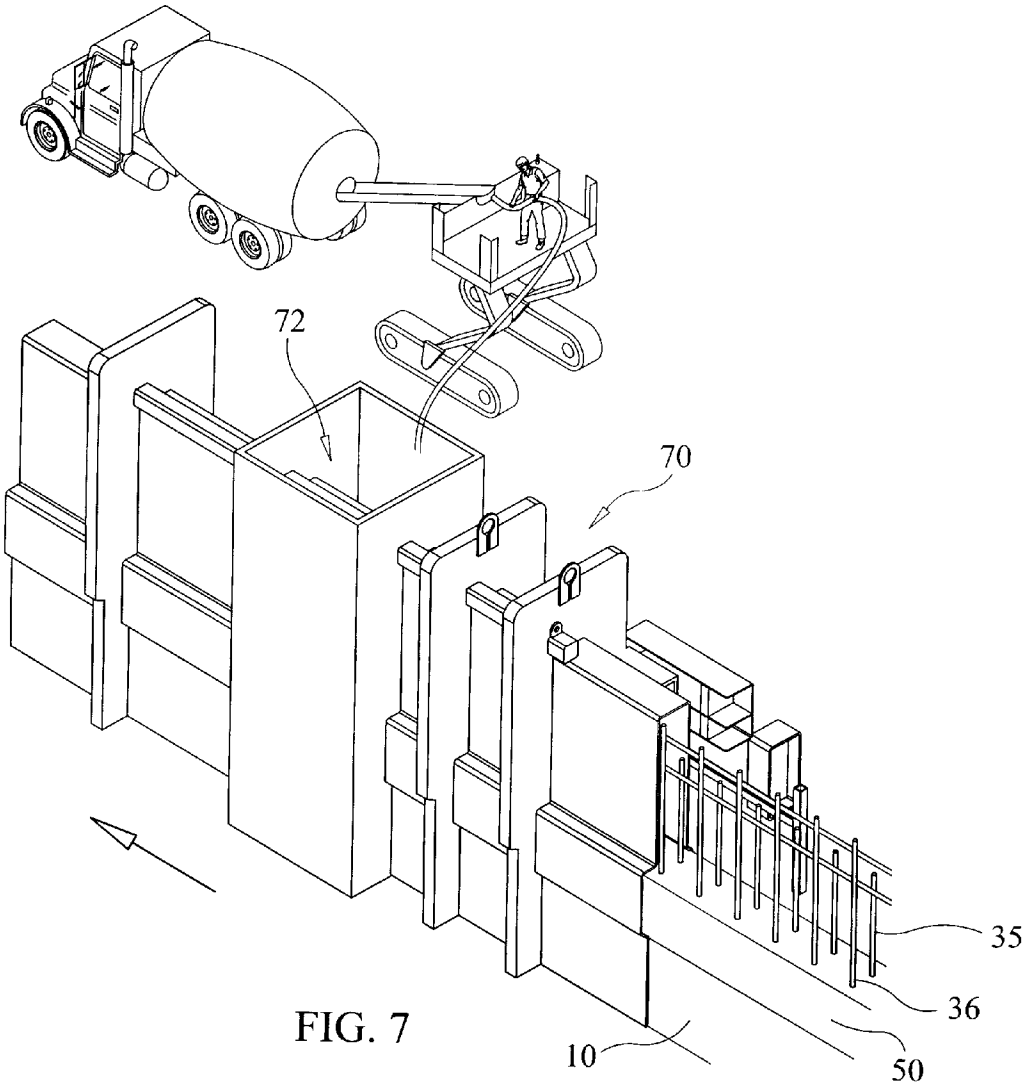
FIG. 7 depicts a second tunnel mold for slip forming of a traffic rail onto the iron work array, incorporating the exposed rebars from the bridge coping of FIG. 6(C).

FIG. 7 depicts an enlarged view of a second tunnel mold (70) for slip forming a traffic rail (50) onto a slip formed bridge coping (10). In this FIG. 7, the second tunnel mold (70) is supported/transported on motorized vehicle (not shown), and progressive advanced, in the direction indicated by the arrow (from right to left) over the iron work array, which extends from within and above the coping (10). Quick setting concrete is dispensed into the hopper (72) of the second tunnel mold (70), and fills the mold cavity. As the second tunnel mold (70) slips over the iron work array (50), a traffic rail (55 of FIG. 9) with exposed rebars (35, 36) is formed.

Figure 8A:
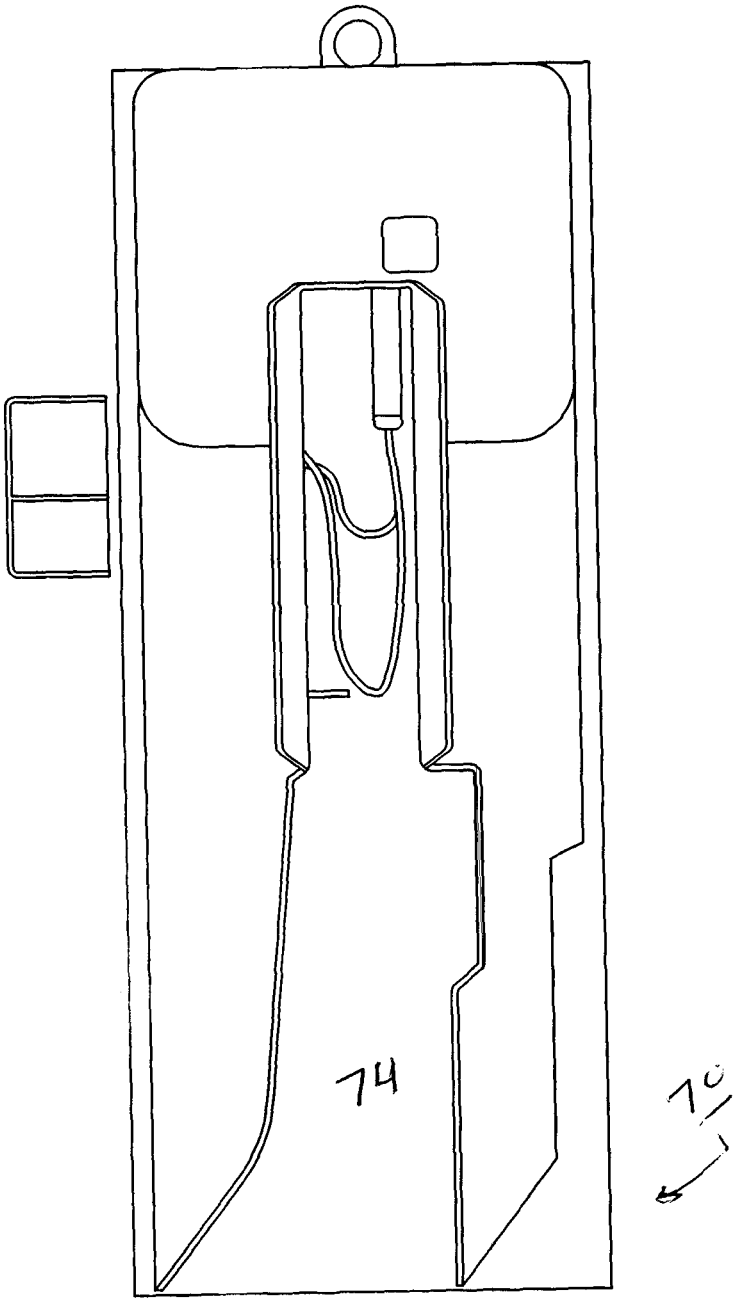
FIG. 8(A) depicts an enlarged view of the second tunnel mold, from the exit end thereof

FIG. 8A depicts an enlarged view of the second tunnel mold (70), from the exit end thereof. The outline of the mold cavity for the traffic rail (50), as is the tunnel (74) through the mold is clearly visible.

Figure 8B:
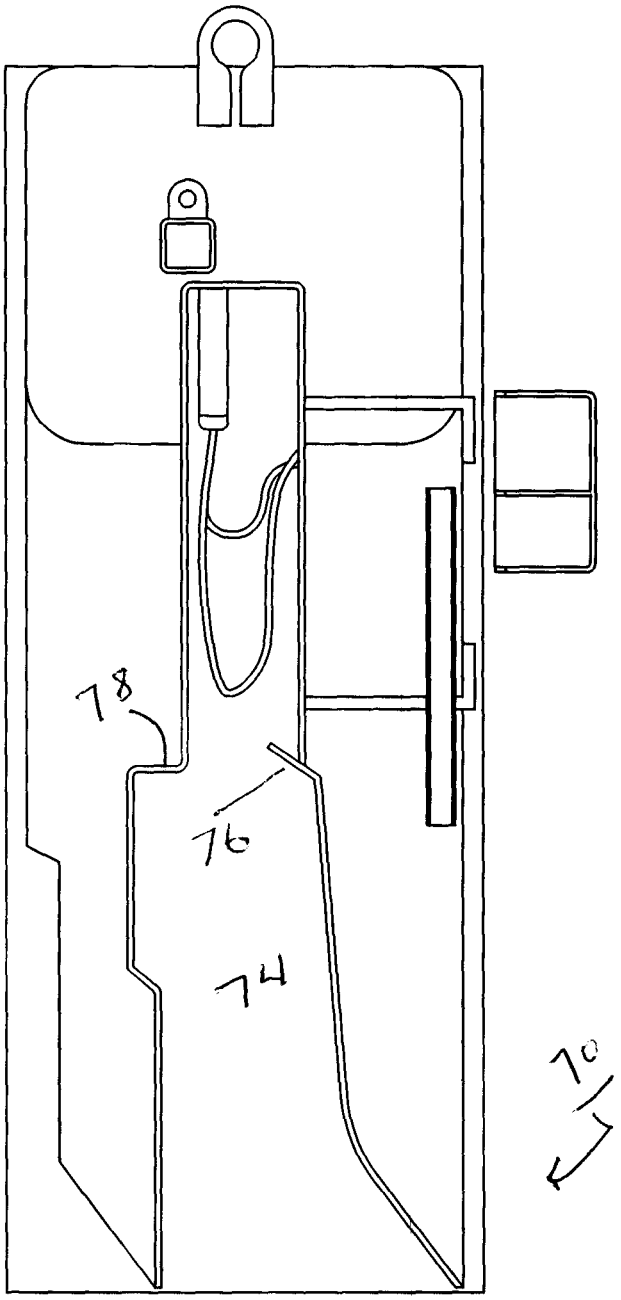
FIG. 8(B) depicts an enlarged view of the second tunnel mold, from the inlet end thereof

FIG. 8B depicts an enlarged view of the second tunnel mold (70), from the inlet end thereof. The outline of the traffic rail (55 of FIG. 9), as is the tunnel (74) through the mold, are each clearly visible. Also depicted are the fins (76, 78) which extend from the bottom of each of the defining walls of the tunnel into the traffic mold cavity.

Figure 8C:
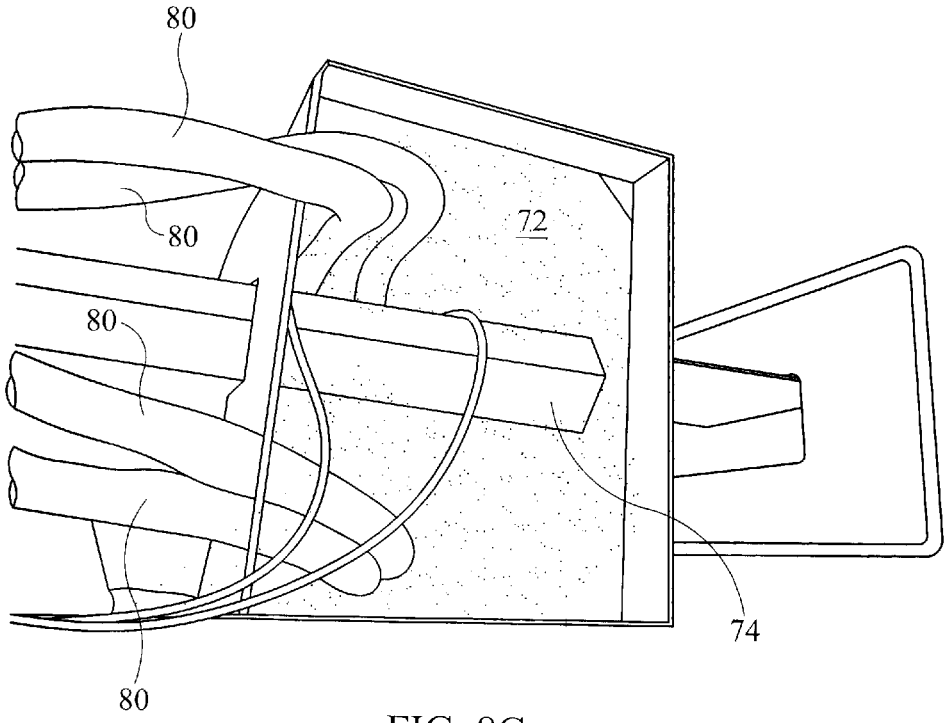
FIG. 8(C) depicts a perspective view, in partial section, from above of the second slip mold, including an open hopper for dispensing concrete into the mold

FIG. 8C depicts an enlarged view of the hopper (72) of the second tunnel mold (70), when viewed from above. Also shown in the view, are a number of vibrators (80) which extend into the hopper (72), and the tunnel (74). The vibrators (80) extend from the top of the hopper (72) into the traffic mold cavity for consolidation of the concrete at the margins of the tunnel (74), and at the margins of the formed traffic rail (55 of FIG. 9).

Figure 9:
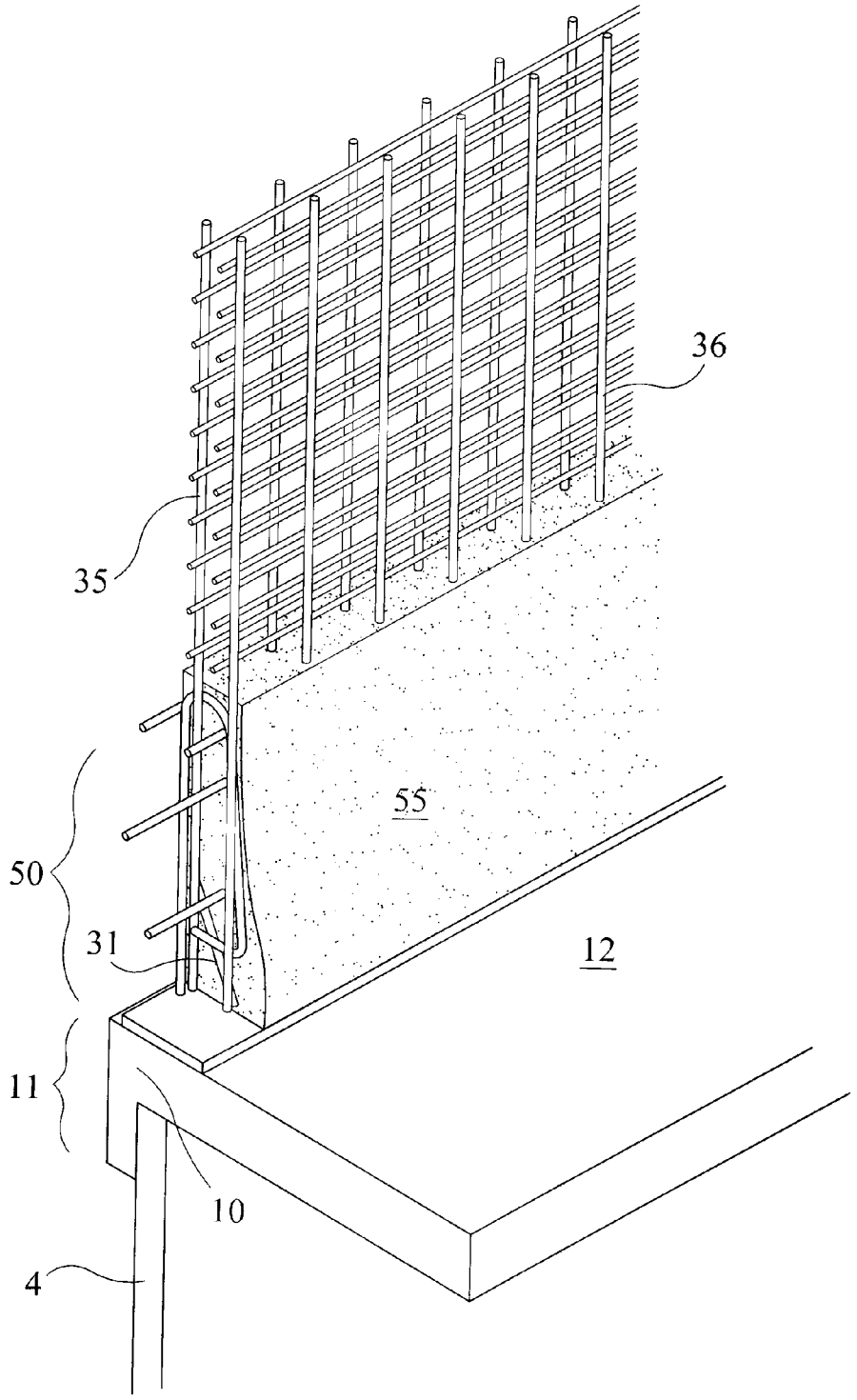
FIG. 9 depicts the slip formed traffic rail of FIG. 6 (C) wherein additional rebars are physically connected/spliced to the iron exposed work array for a traffic rail for later integration into a barrier wall.

FIG. 9 is an enlarged view of the slip formed traffic rail (55), with exposed rebars (35, 36), as it leaves the exit end the second tunnel mold (70). The slip formed traffic rail (55) has both rebars embedded with the formed traffic rail and rebars (35, 36), which are essentially concrete free, that extend from within the slip formed traffic rail (55).

Figure 10:
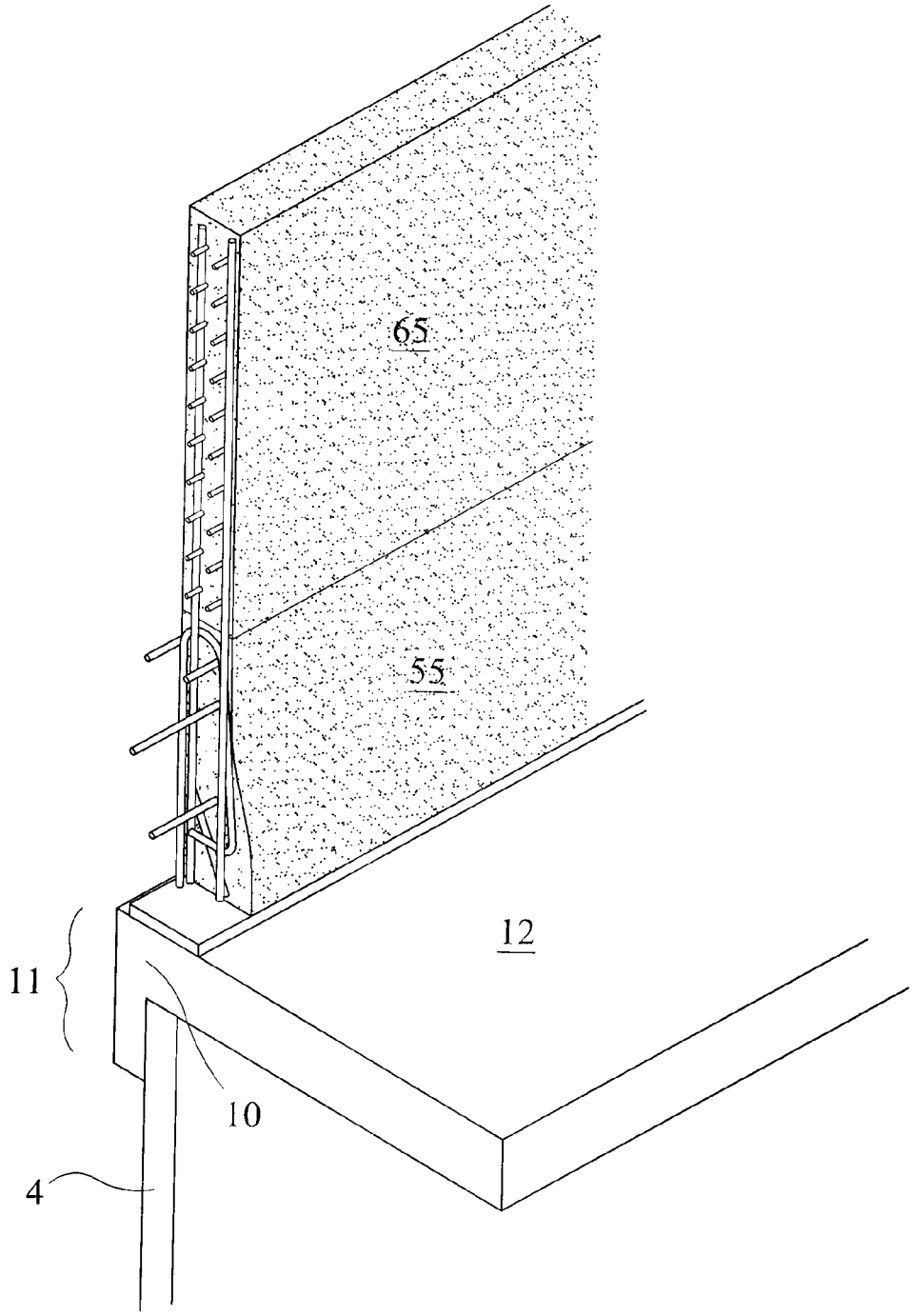
FIG. 10 composite structure having four (4) functionally discrete and integral components

FIG. 10 depicts a composite structure having four (4) functionally discrete and integral components wherein each functionally discrete component shares reinforcement with another component thereof, thereby by creating an integral structure. In this FIG. 10, the integral structure consists of a road pad (12), a bridge coping (10), a coping extension (11) for connecting an MSE wall (4), through the coping (10) to the road pad (12), traffic rail (55) and a barrier wall (65). As noted early on herein, the barrier wall (65) component of this integrated composite structure can be formed by traditional cast-in-place forming techniques. The resultant structure of FIG. 10 would be substantially the same.

In each instance, the reinforcement is continuous from within a prior formed (antecedent) structure, by virtue of exposed reinforcing material from the antecedent structure being incorporated into the successively form component of the composite. Generally additional reinforcement is spliced to the exposed reinforcing material from the antecedent structure, but such additional reinforcement is not necessary in all instances.

The foregoing invention has been described in reference to a number of the preferred embodiments of this tunnel mold, system and method for the sequentially slip forming an integrated reinforced concrete composite having multiple functionally discrete components, for highway and bridge construction.

Both time and space does not permit inclusion all of the potential applications of this process for the formation of integrate reinforced composite structures, nor is the invention limited to the concrete and/or rebar reinforcement. Clearly, this process has potential application to the slip formation of reinforced structural shapes having both an embedded reinforcing member, and an exposed component of such reinforcing member. Thus, the scope of this invention is not limited by the preferred embodiments thereof, which has been il lustrated and described, but rather defined in the following claims.

What is claimed is:

1. A process for sequentially forming composite concrete structural components for road and bridge construction, wherein one or more component parts of the resultant concrete structural components have exposed rebars for the later integration with additional concrete and/or mechanical structural elements, said additional concrete and/or mechanical structural elements selected from the group consisting essentially of barrier walls, barricades, guard rails and any combination thereof, wherein the process comprises:

A. Providing an iron work array wherein said iron work array comprises both (1) rebars for embedding within, and reinforcing, a first concrete highway structure and (2) rebars for extending from within said first concrete highway structure, for integration within and reinforcing a second concrete highway structure, to be formed at a later time;

B. Providing a machine assembly having a tunnel mold comprising a mold cavity defined by a plurality of molding surfaces for forming said first concrete structure having both embedded and exposed rebars, wherein said tunnel mold has a leading or forward molding surface, a trailing or rear molding surface, and at least one tunnel, through said mold cavity, extending from said leading or forward molding surface to said trailing or rear molding surface of said tunnel mold, said tunnel being of a sufficient height to accommodate passage of said extending rebars, through said mold cavity, from said leading or forward molding surface to said trailing or rear molding surface of said tunnel mold;

C. Slip forming said first component of said composite concrete structure by a. Placing said machine assembly, equipped with said tunnel mold, in slip forming relation to said iron work array; and b. Introducing concrete into said machine assembly for transfer into said mold cavity of said tunnel mold assembly, while continuously moving said machine assembly, equipped with said tunnel mold, over said iron work array, to slip form a first component of said concrete composite structure having both rebars embedded in first concrete structure, and concrete free rebars, which extend from said iron work array embedded in said slip formed concrete structure, D. Slip forming a contiguous component onto said first component of said concrete composite structure, by incorporating therein, said concrete free rebars from said first component of said composite concrete structure, as reinforcement of said contiguous component.

2. The process of claim 1, wherein said tunnel mold of said machine assembly comprises:

1) A mold housing including a) A hopper, a mold cavity and one or more channels through said housing and said mold cavity, i. Said hopper comprising a means for receiving concrete and directing flow of said concrete into said mold cavity, ii. Said mold cavity defining a shape of a concrete structure to be formed on said iron work array, and iii. At least one channel comprising an elongate opening extending through said mold housing, from front to back of said mold housing, and into and above said mold cavity, each of said channel being defined by lateral side walls, an open bottom end thereof in communication said mold cavity; and B. Means for supporting said mold housing on a slip mold transporter.

3. The process of claim 1, wherein said tunnel mold of said machine assembly includes a plurality vibrating means within said mold cavity to effect consolidation of the concrete within said mold cavity and thereby eliminate any voids or lack of continuity of said concrete within a slip formed structure.

4. The process of claim 1, wherein said tunnel mold of said machine assembly auger means for distribution of concrete within said tunnel mold and into said mold cavity.

5. The process of claim 1, wherein said tunnel mold of said machine assembly includes a pair of fins associated with each of said lateral side walls of each elongate channel, and extending therefrom into said unset concrete within said mold cavity, so as to substantially minimize unset concrete from flowing from within said mold cavity into each of said elongate channels and covering said rebars which extend from said iron work array into said channels, and thereby pass through said mold cavity essentially concrete fee.

6. The process of claim 1, wherein said iron work array is pre-configured to reinforce a slip formed traffic rail.

7. The process of claim 1, wherein said iron work array is pre-configured to reinforce a slip formed bridge coping and a slip formed road bed bad.

8. The process of claim 1, wherein said a portion of said iron work array is pre-configured to reinforce a slip formed traffic rail and a portion thereof to extend from within said slip formed traffic rail for later incorporation into and reinforcement of a concrete barrier wall, formed on top of said coping.

9. A slip formed composite, reinforced concrete structure having

A. A first slip formed concrete component of said composite, having at least a portion of an array of reinforcing material embedded within said first concrete component of said first component, and a portion of said reinforcing material extending from within said first component and essentially concrete free; and B. At least one additional contiguous slip formed concrete component of said composite slip concrete composite wherein said additional contiguous slip formed concrete component is reinforced in part, with reinforcing materials extending from within said first component of said composite incident to slip forming thereof upon said first slip formed component.

10. The slip formed composite, reinforced concrete structure of claim 9, wherein said reinforcing materials of said first slip formed concrete component, which extend from within said first slip form concrete component, have additional reinforcing material spliced thereto to effectively extend said reinforcing material, to reinforce a contiguous, concrete component of said composite.

11. The slip formed composite, reinforced concrete structure of claim 9, wherein said reinforced materials of said first slip formed concrete component, which extend from within said first slip form concrete component, have additional reinforcing material spliced thereto to effectively extend said reinforcing material, to reinforce a contiguous, slip formed concrete component of said composite.

12. The slip formed composite, reinforced concrete structure of claim 10, wherein said contiguous, slip formed concrete component of said composite is a barrier wall.

13. The slip formed composite, reinforced concrete structure of claim 10, wherein said contiguous, slip formed concrete component of said composite is a slip formed barrier wall.

14. A slip formed barrier wall composite structure having

A. A first slip formed concrete component having at least a portion of an array of reinforcing material embedded within said first slip formed concrete component, and a portion of said reinforcing material extending from within said first slip formed concrete component wherein said reinforced materials of said first slip formed concrete component, which extends from within said first slip form concrete component, have additional reinforcing material spliced thereto to effectively extend said reinforcing material from said first slip formed concrete component, to reinforce a contiguous, slip formed concrete component of said composite; and B. At least one additional slip formed concrete component contiguous with said first slip formed concrete component of said composite slip concrete composite, wherein said additional contiguous slip formed concrete component is reinforced in part, with reinforcing materials extending from within said first slip formed concrete component, incident to slip forming said contiguous, slip formed concrete component thereof upon said first slip formed concrete component.

15. The slip formed barrier wall composite structure of claim 14, wherein said first slip formed concrete component is a traffic rail.

16. The slip formed barrier wall composite structure of claim 14, wherein said first slip formed concrete component is bridge coping.

17. The slip formed barrier wall composite structure of claim 14, wherein said first slip formed concrete component is a road pad.

* * * * *